United States Patent [19]

Marugama et al.

[11] Patent Number: 4,882,247

[45] Date of Patent: Nov. 21, 1989

[54] ELECTROPHOTOGRAPHIC IMAGE RECORDING METHOD

[75] Inventors: Kazuo Marugama; Kiyoshi Horie; Tsuneo Noami; Toshiro Yamamoto; Koji Adachi; Toru Okamoto; Takeshi Sumikawa; Furuya Nobumasa, all of Kanagawa, Japan

[73] Assignee: Fuji Xerox Co., Ltd., Tokyo, Japan

[21] Appl. No.: 121,807

[22] Filed: Nov. 17, 1987

[30] Foreign Application Priority Data

| | | | |
|---|---|---|---|
| Nov. 18, 1986 | [JP] | Japan | 61-272790 |
| Dec. 4, 1986 | [JP] | Japan | 61-287809 |
| Jan. 23, 1987 | [JP] | Japan | 62-12234 |
| Apr. 13, 1987 | [JP] | Japan | 62-88626 |
| Apr. 13, 1987 | [JP] | Japan | 62-88628 |
| Jun. 10, 1987 | [JP] | Japan | 62-143301 |

[51] Int. Cl.[4] ..... G03G 13/01

[52] U.S. Cl. ..... 430/45; 430/54; 430/126

[58] Field of Search ..... 430/45, 54

[56] References Cited

U.S. PATENT DOCUMENTS

| | | | |
|---|---|---|---|
| 4,124,385 | 11/1978 | O'Horo . | |
| 4,238,558 | 12/1980 | Ziolo . | |
| 4,245,026 | 1/1981 | Ziolo . | |
| 4,539,281 | 9/1985 | Tanaka et al. | 430/45 |

FOREIGN PATENT DOCUMENTS

| | | |
|---|---|---|
| 0066141 | 12/1982 | European Pat. Off. . |
| 0142731 | 5/1985 | European Pat. Off. . |
| 1586193 | 3/1981 | United Kingdom . |

*Primary Examiner*—J. David Welsh

*Attorney, Agent, or Firm*—Finnegan, Henderson, Farabow, Garrett and Dunner

[57] ABSTRACT

Image recording method of the present invention comprises the steps of forming electrostatic latent image on a latent image carrier by a latent image forming means, developing the formed electrostatic latent image with toner, and transferring the visualized toner image to a transfer material after repeating at least the developing step plural times, wherein double-element developer formed from mixing toner and magnetic carrier with its density of 4.0 g/cm$^3$ or less is used in at least the second and the succeeding developing steps among the plural times of the developing steps.

7 Claims, 20 Drawing Sheets

ELECTROPHOTOGRAPHIC IMAGE RECORDING METHOD

BACKGROUND OF THE INVENTION

The present invention relates to a method for recording images or pictures with utilizing electrostatic latent image, and particularly to a picture recording method for obtaining toner image by developing, without disturbance, visualized image (toner image) formed previously on latent image carrier.

Various color image recording methods utilizing electronic photography method have been proposed. As such color picture recording method, for example, so-called a repeated developing method has been proposed. The repeated developing method obtains color picture by the processes that the electrostatic latent images of two or three levels are formed on a single photosensitive medium, the first latent image of photosensitive medium having such latent images of two or three levels is developed by a first developing device, thereafter the second latent image on the photosensitive medium is developed by a second developing device and a finally formed toner image is then transferred at a time. This method is very effective in realizing reduction of size and high copying speed.

However, in such repeated developing method, the photosensitive medium carrying toner image through the first developing process is then rubbed by the developer in the second and successive processes and thereby the toner image formed by the first developing process is disturbed remarkably by the second and successive developing processes. As a result, this method is accompanied by the problem that the color picture finally obtained is considerably disturbed. Therefore, it is a very important subject for the picture forming method utilizing the repeated developing method to realize the development of the successive stages without disturbing toner images of preceding stages.

It is also considered to achieve the developing processes in the successive stages with the single-element non-contact development in order not to disturb the toner image on the photosensitive medium. However, the single-element non-contact development has difficulty of high speed operation and it is therefore desirable, from this point of view, to use the double-element developer consisting of carrier and toner.

However, in the magnetic brush developing method, development is carried out by depositing the double-element developer on a non-magnetic sleeve having a magnet roll therein and rubbing a latent image with magnetic brush. However, in the repeated developing method, the toner image formed in the developing process of the preceding stage is disturbed because the toner image is rubbed with the tip part of the magnetic brush in the developing process of the succeeding stage.

As a means for solving such problems, the Japanese patent application unexamined publication No. 126665/1985 proposes a color image developing device which uses the double-element developer mixing the magnetic carrier with its grain size of 50 μm or less with the toner particle. However, reduction in grain size of carrier improves disturbance of image, but when the grain size becomes smaller, the more carrier transfers to the surface of photosensitive medium from the developing device, namely the carry over phenomenon becomes more distinctive. In order to avoid the, carry over phenomenon, a magnetic force must be enhanced as much. Accordingly, it is required to make large a certain degree the grain size of carrier particle. Therefore, only regulation of grain size of carrier cannot result in sufficiently satisfied result.

On the other hand, various image forming methods to easily form and record composite pictures utilizing electronic photography method have been proposed. As such a picture forming method, a so-called repeated negative exposing method is typical as the method using a single developing device. In this method, after the photosensitive medium of the electronic photography is uniformly charged, a latent image of first picture is negatively written on the photosensitive medium by the exposing means to expose image parts. A latent image of second picture is also formed by the negative writing method to combine the second picture with the first picture and the first and second latent images are inversed at a time to form the composite picture.

Meanwhile, as a composite picture forming method utilizing two developing devices, a method to form a combined picture by the process consisting of charging, first negative (or positive) image exposing, second positive (or negative) image exposing, first developing (regular developing or inverse developing) and second developing (inverse developing or regular developing) is already known.

Moreover, the Japanese patent application unexamined publication No. 2047/1982 discloses a method utilizing the image forming process consisting of charging—first negative image exposing—first developing (inverse developing)—second positive image exposing—second developing (regular developing).

However, the repeated negative image exposing method is certainly simplified in the structure but also has a disadvantage that the pictures cannot be combined on the ordinary positive document.

SUMMARY OF THE INVENTION

The present invention is proposed herein considering problems mentioned earlier. It is therefore an object of the present invention to provide a method of recording images which realize development without disturbing the existing toner image even if the double-element developer is used.

Furthermore, it is an object of the present invention to provide a color image recording method which uses the double-element developer which realizes developing without disturbing existing toner image. It is also an object of the present invention to provide a picture recording method which can combine pictures to a positive document, ensure good reproducibility of low concentration picture, eliminate disturbance of image formed by the first developing and prevent picture quality from being gradually deteriorated.

The inventors of the present invention have completed the present invention by finding that density of carrier used in the double-element developer is very important factor for disturbance of the toner image through investigation with a magnetic brush developing device utilizing the double-element developer.

Therefore, the image recording method of the present invention comprises the steps of: forming electrostatic latent image on a latent image carrier by a latent image forming means; developing the formed electrostatic latent image with toner; and transferring the visualized toner image to a transfer material after repeating at least the developing step plural times, wherein double-element developer formed from mixing toner and magnetic carrier with its density of 4.0 g/cm$^3$ or less is used in at least the second and the succeeding developing steps among the plural times of the developing steps.

Any carrier having the density of 4.0 g/cm$^3$ or less may be used in the present invention. For example, the carrier having porous surface, ferrite carrier or the carrier in which magnetic powder is dispersed into the resin as the binder may be used (It is, of course, required that these carriers should have the density of 4.0 g/cm$^3$ or less.) The carrier obtained by dispersing magnetic powder into the resin as the binder is preferable because it can easily control the density depending on the content of magnetic powder included. From the result of experiment, it has become obvious that if the density $\rho$ is in the range of from 1.7 to 4.0 g/cm$^3$, preferably in the range of from 1.7 to 3.0 g/cm$^3$, image disturbance and carry over phenomenon can be controlled in the allowable range. It can be estimated from the fact that the magnetic brush or tip part formed becomes soft since each carrier has small density.

Density of carrier used in the present invention can be defined by the density obtained with true specific gravity measured by the following measuring method.

In the so-called pycnometer method (true specific gravity bottle method) where the spaces of powder are perfectly replaced with liquid and the true specific gravity is obtained by substituting the relation between weight and volume to the following equation, the true specific gravity is obtained from the following equation using a measuring equipment; auto-true denser MAT-5000 (developed by Seishin Corp.) for automatic pyonometer method.

$$Pd = \frac{(Wb - Wa)}{Wb - Wa - Wc + Wd} \times Ld$$

(In this equation, Pd: true specific gravity; Ld: specific gravity of liquid; Wa: cell tear (vacant cell) (g); Wb: cell tear+powder (g); Wc: cell tear+powder+liquid (after determination of liquid surface) (g); Wd: cell tear+liquid (after determination of liquid surface) (g))

BRIEF DESCRIPTION OF THE DRAWING

In the accompanying drawing.

DETAILED DESCRIPTION OF THE PREFERRED EMBODIMENTS

Figure 1:
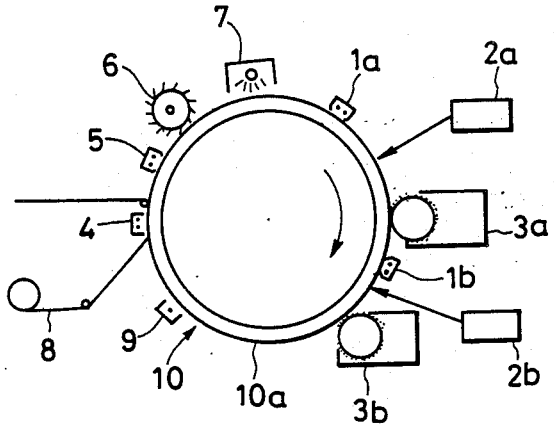
FIG. 1 shows structure of an example of a color picture recording apparatus used for enforcement of the first embodiment of the present invention.

With reference to the accompanying drawing, the preferred embodiments of the present invention will be described below in greater detail.

The first and second embodiments of the present invention will be described below, with reference to the accompanying drawing. The first embodiment is a color image recording method, to which the present invention is applied. The second embodiment is a composite image recording emthod, to which the present invention is applied.

According to the first and second embodiment of the presnet invention, in the developing processes (at the second and the succeeding developing processes), any kind of double-element developing devices may be used but it is preferable to use the most ordinary magnetic brush developing device.

The magnetic brush developing device forms a magnetic brush by depositing the double-element developer on the developing roll consisting of a magnet roll having a plurality of magnetic poles and non-magnetic cylindrical sleeve provided at the circumference thereof and adjusting the length of the tipping part or magnetic brush with a freely selected magnetic brush or tipping part limiting member and realizes development through adhesion of toner to the latent image by rubbing the photosensitive medium surface provided opposed to the magnetic brush while moving the magnetic brush through the relative movement of magnet roll and sleeve. In this case, it is desirable from the viewpoint of preventing disturbance of image, to fix the magnet roll and rotate the sleeve. Moreover, it is also desirable that the rotating direction of sleeve is the same as the photosensitive medium at the developing part. In addition, it is most desirable that the magnet roll fixed in the interior is arranged at least at the developing nip position in such a manner as forming repulsion magnetic field.

The grain size of carrier particle of low density in the first and second embodiments of the present invention can be selected freely, but the average grain size of from 25 to 50 $\mu$m is desirable from the result of experiment and particularly the average grain size of about 30 $\mu$m is the most suitable. It is because if the average grain size deviates from said range, it becomes difficult to attain the balance of preventing carry over phenomenon and image disturbance phenomenon.

The first embodiment of the present invention will be described hereinafter, with reference to FIGS. 1 through 5. The first embodiment of the presnet invention is a color image recording method, to which the present invention is applied. The color image recording method of the first embodiment comprises a latent image forming process to form electrostatic latent image on a latent image carrier by a latent image forming means, a developing process to visualize the formed electrostatic latent image with different toners for two or more colors and a transfer process for transferring visualized color toner image to a transfer material after repeating several times at least the developing process among the latent image forming process and the developing process, in which a kind of double-element developer formed from mixing the toner and the magnetic carrier with its density of 4.0 g/cm$^3$ or less is used in the developing processes of at least the second and the succeeding trials among the plural times of the developing processes.

Figure 2:
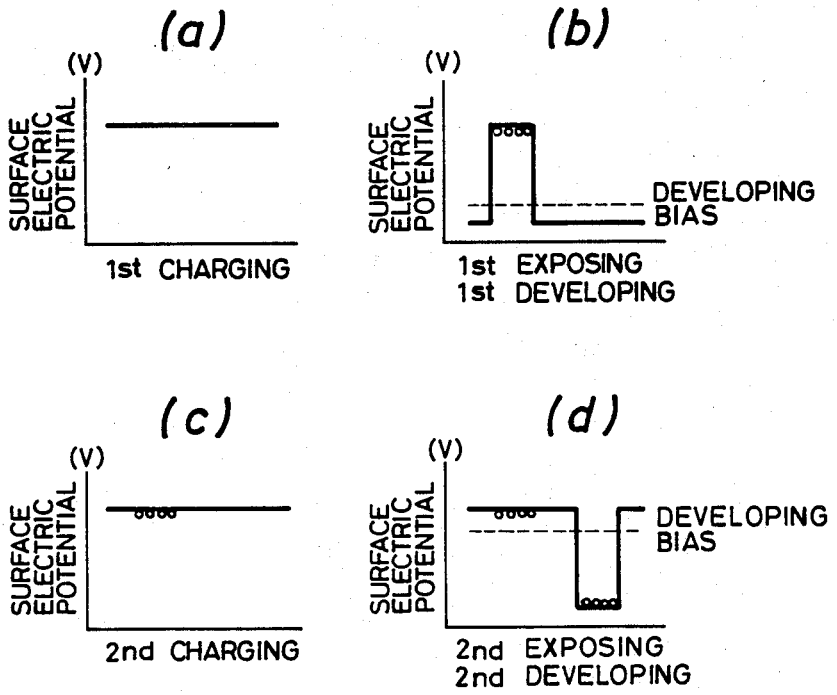
FIG. 2 indicates the diagrams for explaining surface voltage of photosensitive medium and developing condiction when the color picture recording apparatus of FIG. 1 is operated.

FIG. 1 shows one example of a color picture recording apparatus used for the color image recording method of the first embodiment of the present invention to form color picture through formation of 2-level latent images. FIG. 2 indicates the surface electric potential of photosensitive medium and developing condition in case the color picture recording apparatus of FIG. 1 is operated. In FIG. 1, 1*a* is a first charger, 2*a* is a first exposing means, 3*a* is a first developing means, 1*b* is a second charger, 2*b* is a second exposing means., 3*b* is a second developing means, 4 is a transfer corotoron, 5 is a preclean corotoron, 6 is a cleaner, 7 is an optical preclean, 8 is a recording paper, 9 is a pretransfer corotoron, 10 is a photosensitive drum, 10*a* is a photosensitive layer.

The operation of the apparatus of FIG. 1 is as follows:

The photosensitive drum 10 rotates in the direction indicated by the arrow mark. First, the photosensitive layer 10*a* at the surface of photosensitive drum 10 is uniformly charged by the first charger 1*a* (FIG. 2(*a*)).

Then, light irradiation is carried out depending on the picture information corresponding to a first color by the first exposing means 2*a* and the electrostatic latent image is formed corresponding to the first color on the photosensitive medium. As the exposing means, any type of exposing means may be used. The developing bias voltage is selected in accordance with the kind of the achieved development, that is, an inverse or regular development. Thereafter, the toner corresponding to the first color is supplied to visualize the image by the first developing means 3*a* to the photosensitive layer 10*a* having the first electrostatic latent image formed by the first exposing means (FIG. 2(*b*)). The color of toner may be different from the first color. As the first developing means, any type of developing means may be used. In this case, the developing bias is selected depending on the regular developing or inverse developing to be carried out.

Next, the photosensitive layer 10*a* is uniformly charged again by the second charger 1*b* (FIG. 2(*c*). This second charger 1*b* may be omitted depending on the image forming process. For example, in case negative image is written in the first exposing part and positive image is written in the second exposing part, such second charger may be omitted. Thereafter, light irradiation is carried out depending on the picture information corresponding to the second color by the second exposing means 2*b* and the latent image depending on the second color is formed on the photosensitive layer 10*a*. The exposing means and writing system may be selected freely. The toner corresponding to the second color is then supplied to visualize the image by the second developing means 3*b* to the photosensitive layer 10*a* having the second electrostatic latent image formed by the second exposing means (FIG. 2(*d*)). In this case, the color of toner may also be different from the second color and the developing bias can also be selected freely.

The pre-transfer corotoron 9 is used to match the polarities of first and second toners deposited on the photosensitive medium before transfer and it also may be omitted for the particular process. The first toner image and the second toner image are transferred by the transfer corotoron 4 on the recording paper but such transfer may also be done using the means other than the electrostatic transfer. The image is then fixed on the recording paper in the fixing part not illustrated. The photosensitive medium having passed the transfer part enters the cleaning process by the preclean corotoron 5, cleaner 6 and photoprecleaner 7 for successive use.

As the first and second exposing means, those consisting of the light irradiation means, document scanning means and optical system for focusing may be used but various kinds of devices such as the optical writing device which realizes optical modulation depending on the picture information, for example, the laser writing device, liquid crystal light bulb consisting of uniform light source and liquid crystal micro-shutter or LED array, optical fiber may be used as desired considering the purposes.

In the first embodiment of the present invention, two kinds of developers in different color phases are used as the developer for use of the color recording apparatus indicated in FIG. 1, but it is essential to use the double-element developer consisting of the toner and the magnetic carrier with its density of 4.0 g/cm$^3$ or less in the at least second developing means of the first and second developing means.

Figure 3:
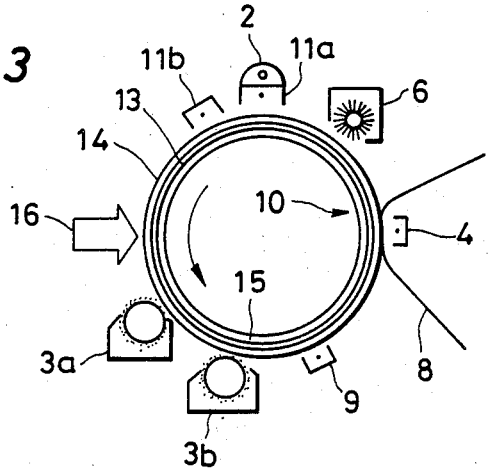
FIG. 3 shows structure of another exmaple of a color picture recording apparatus used for enforcement of the first embodiment of the present invention.
Figure 4:
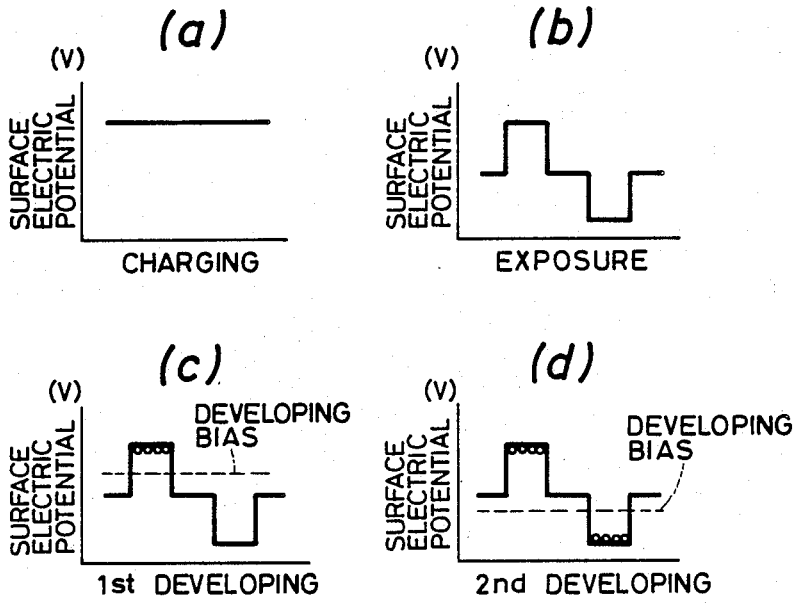
FIG. 4 indicates the diagrams for explaining surface voltage of photosensitive medium and developing condition when the color picture recording apparatus of FIG. 3 is operated.

FIG. 3 shows another color picture recording apparatus used for the color image recording method of the first embodiment, in which the color picture may be formed by formation of the 3-level latent images. FIG. 4 indicates surface potential of photosensitive medium and developing condition when the color picture recording apparatus of FIG. 3 is operated. In FIG. 3, 11*a* is primary charger; 11*b* is secondary charger; 12 is uniform exposing device; 13 is first photosensitive layer; 14 is second photosensitive layer; 15 is base material; and 16 is laser source. Other reference numerals indicate the same elements as those in FIG. 1.

The operation of the apparatus of FIG. 3 is as follows:

First, while the surface of photosensitive drum 10 is uniformly exposed with the uniform exposing device 12, it is subjected to the primary charging with the primary charger 11*a* and is then subjected to the secondary charging in the reversed polarity from the primary charging with the secondary charger 11*b* (FIG. 4(*a*)). Next, the surface is then exposed by the laser beam in the intensity of two levels obtained by modulation of the laser beam from the laser source 16 in order to form the latent image of three levels (FIG. 4(*b*)). Next, while the developing bias is applied, the toner corresponding to the first color is supplied by the first developing means 3*a* for visualizing the image (FIG. 4(*c*)). Moreover, the developing bias is selected and the toner corresponding to the second color is then supplied by the second developing means 3*b* for visualizing the image (FIG. 4(*d*)). The visualized toner image is then transferred to the recording paper and is then fixed thereon as explained earlier regarding FIG. 1.

Experiment 1

The double-element developer to be used in the first embodiment of the present invention is manufactured as explained below.

Carrier:

The following carriers were obtained by mixing the copolymer of stylene-n-butylmethacrylate (density: 1.1 g/cm$^3$) and cubic type magnetite (density: 4.8 g/cm$^3$) in the rate indicated below, then kneading melted raw materials and finally milling such materials.

| Carrier No. | Resin/magnetic powder (weight part) | Density (g/cm$^3$) | Average grain size (μm) |
|---|---|---|---|
| 1 | 20/80 | 2.9 | 30 |
| 2 | 35/65 | 2.2 | 30 |
| 3 | 50/50 | 1.8 | 30 |
| 4 | 65/35 | 1.5 | 30 |

Toner:

The toner with its average grain size of 9.8 μm was obtained by kneading melted resin with 92 weight part obtained through graft polymer of low molecule polyolefin to the stylenebutylmethacrylate copolymer and the red color pigment (for example, resolscarlet, manufactured by BASF AG) with 8 weight part and then milling such kneaded material.

Double-element developer:

The developer was obtained by mixing the above-indicated carrier with 90 weight part and the above-indicated toner with 10 weight part.

The testings were conducted using the color picture recording apparatus indicated in FIG. 3. Here, the Se system photosensitive medium was used and the charging voltage of the first and second chargings was 1100 V. For the exposure, the He-Ne laser (pulse width was modulated by a single laser) was used and the electrostatic latent image of 3-level was formed in the voltages of 1100 V for the non-exposed region, 700 V for the intermediately exposed region and 200 V for full exposed region. Then, while the developing bias of 800 V was applied, the black toner image was formed by the double-element magnetic brush method with the first developing means. Next, while the developing bias of 600 V was applied, the red toner image was formed by said double-element magnetic brush method with the second developing means.

For comparison, the testings were also conducted using following carriers of double-element developer to be used for the second developing means.

| Carrier No. | | (g/cm$^3$) | Average grain (μm) |
|---|---|---|---|
| 5 | Iron system carrier | $\rho$ =7.8 | 60 |
| 6 | Ferrite | 4.5 | 60 |
| 7 | Ferrite | 4.5 | 15 (5~50 μm) |

Figure 5:
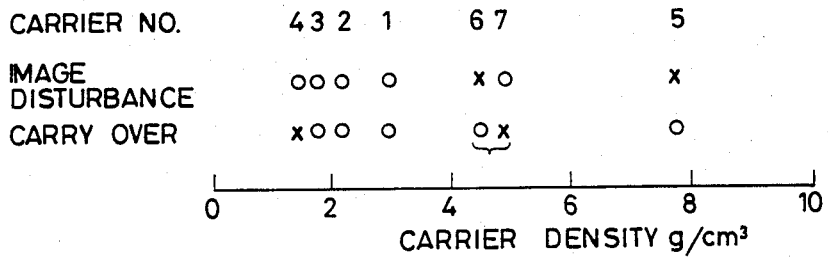
FIG. 5 indicates a diagram for explaining relationship between carrier density and image disturbance and carry over phenomenon.

Relationship between the carrier density and image disturbance and carry over phenomenon in these tests was indicated in FIG. 5. In FIG. 5, the circle O means no image disturbance or no carry over phenomenon, while cross × means generation of image disturbance and carry over phenomenon.

Experiment 2

The testings were conducted under the same conditions as the test sample No. 4 used in the Experiment 1, with using the color picture recording apparatus of FIG. 1. The first exposure was the regular exposure (exposure of the no picture part) and the second exposure was the inversed exposure (exposure of picture part). The surface voltage of photosensitive medium by the first charging was 900 V and voltage of exposure part by the first exposure was 200 V. The first developing was carried out using the black toner with the developing bias voltage of 300 V. Moreover, the surface voltage of photosensitive medium by the second charging was 900 V and voltage of exposure part by the second exposure was 200 V. The second developing was carried out using the red toner with the developing bias of voltage of 800 V. The result of testing was the same as that of test sample No. 4 of the Experiment 1.

According to the color picture recording method of the first embodiment of the present invention for the repeated development with the magnetic brush method using the double-element developer, the toner image in the preceding stage in the repeated developing is not disturbed and the carry over phenomenon is not generated. Therefore, high quality color picture without disturbance can be obtained by the present invention.

The second embodiment of the present invention will be described hereinafter with reference to FIGS. 6 to 7. The second embodiment is a composite image recording method, to which the present invention is applied. The image recording method of the second embodiment comprises a latent image forming process to form electrostatic latent image on a latent image carrier by a latent image forming means, a developing process to visualize the formed electrostatic latent image with different toners for single color and a transfer process for transferring visualized toner image to a transfer material after repeating several times at least the developing process among the latent image forming process and the developing process, wherein a kind of double-element developer formed from mixing the toner and the magnetic carrier with its density of 4.0 g/cm$^3$ or less is used in the developing process of at least the second and the succeeding trials among the plural times of the developing processes.

Figure 6:
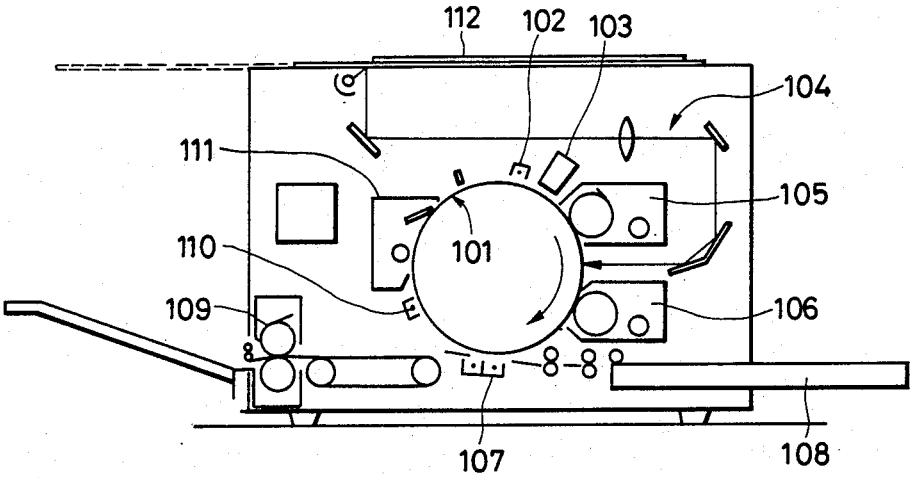
FIG. 6 shows structure of an example of a picture recording apparatus used for enforcement of the second embodiment of the present invention.

FIG. 6 is an example of a picture recording apparatus to be used for the image recording method of the second embodiment of the present invention. FIG. 7 indicates the surface electric voltage of photosensitive medium and developing condition when the picture recording apparatus of FIG. 6 is operated. In FIG. 6, 101 is a photosensitive drum, 102 is a charging corotoron, 103 is and LED array, 104 is an exposing means, 105 is a first developing means, 106 is a second developing means, 107 is a transfer corotoron, 108 is a recording paper, 109 is a fixing means, 110 is preclean corotoron, 111 is a cleaner and 112 is an original document.

The operation of the apparatus of FIG. 6 is as follows.

Figure 7:
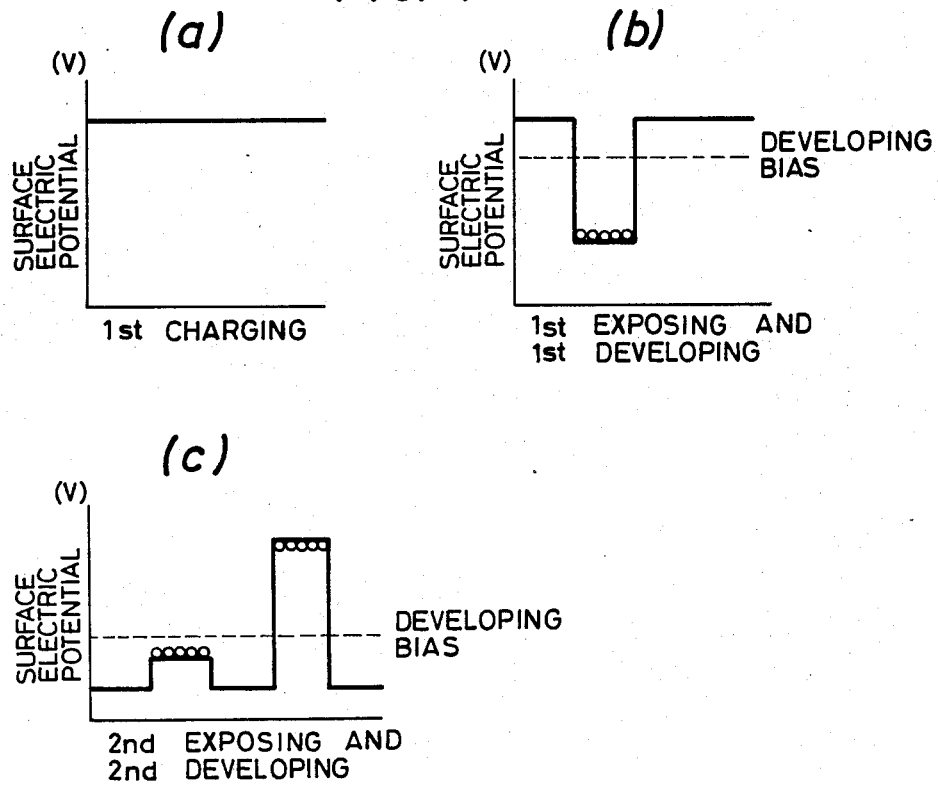
FIG. 7 indicates surface voltage of photosensitive medium and developing condition when the picture recording apparatus of FIG. 6 is operated.

The surface of photosensitive drum 101 is uniformly charged by the charging corotoron 102 (FIG. 7(*a*)) Then, light irradiation is carried out depending on picture information by the LED array 103 and thereby a first electrostatic latent image is formed on the photosensitive medium. Next, while an adequate bias voltage is applied, the first toner image is formed by developing with the first developing means 105 (FIG. 7(*b*)). In succession, the electrostatic latent image corresponding to the picture of original document 112 is formed by the positive image developing with the exposing means 104 consisting of the light irradiation means, document scanning means and optical focusing system. Moreover, while the developing bias voltage is set to the adequate value, developing is conducted by the second developing means 106 to form the second toner image (FIG. 7(*c*)). The toner image is thus formed by the repeated developing on the surface of photosensitive drum 101. This toner image is transferred to a recording paper 108 by the transfer corotoron 107 but it may be transferred by the means other than the electrostatic transfer means. The image on the recording paper is then fixed by the fixing means 109. The photosensitive drum 101 enters the cleaning process by the preclean corotoron 110 and the cleaner 111 for repeated use.

In FIG. 6, the LED array is used as the first exposing means, while the means consisting of the light irradiation means, document scanning means and optical focusing system as the second exposing means. These first and second exposing means may be replaced with other well known means.

In the second embodiment, the developer of the single color is used as the developer for use of the color recording apparatus indicated in FIG. 6. It is essential to use the double-element developer consisting of the toner and the magnetic carrier with its density of 4.0 g/cm$^3$ or less in the at least second developing means of the first and second developing means.

EXPERIMENT

The testings were conducted utilizing the picture recording apparatus indicated in FIG. 6. In the testings, the same double-element developers as used in the testings achieved to the first embodiment of the present invention were used. In other words, the double-element developers used in the following testings were the developers manufactured as described already in the first embodiment which contain the carriers Nos. 1 through 4, and Nos. 5 through 7 for comparison.

As the photosensitive medium, an organic semiconductor system material was used. The charging voltage was 900 V. As the first exposure, LED array was used and the latent image was formed to the non-exposing region with 900 V and to the exposing region with 200 V. Next, while the developing bias voltage of 800 V was applied, the black toner image was formed by the double-element magnetic brush method with the first developing means. Next, the electrostatic latent image corresponding to the picture of original document was newly formed by the second image exposing using the exposing means consisting of the light irradiation means, document scanning means and optical focusing system. This electrostatic latent image developed by the double-element magnetic brush method with the second developing means and thereby the black toner image was formed. In this case, the developing bias voltage was set to 300 V.

Relationship between the carrier density and image disturbance and carry over phenomenon in the testing was the same as shown in FIG. 5.

According to the picture recording method of the second embodiment of the present invention which conducts repeated developing by the magnetic brush method using said double-element developer, pictures can be combined to the positive original document and moreover reproducibility of low concentration picture is good. The picture formed by the first developing is not disturbed by the second developing and the carry over phenomenon is also not generated. Therefore, high quality picture without disturbance of image can be obtained by the present invention.

The third embodiment of the present invention will be described with reference to FIGS. 8 to 14. The third embodiment is color image recording method, to which the presnet invention is applied.

A color picture recording method of the third embodiment comprises a latent image forming process to form electrostatic latent image on a latent image carrier by a latent image forming means, a developing process to visualize the formed electrostatic latent image with different toners for two or more colors and a transfer process for transferring visualized color toner image to a transfer material after repeating several times at least the developing process among the latent image forming process and the developing process, wherein double-element developer formed from mixing the toner and the magnetic carrier with its density of 4.0 g/cm$^3$ or less is used in the developing processes of at least the second and the following trials among the plural times of the developing processes and wherein the developer filling rate in the developing nip is ranged from 10 to 50%. The magnetic carrier used in the third embodiment is formed by dispersing the magnetic powder into the resin as the binder and the density thereof should be 4.0 g/cm$^3$ or less. The density can be easily controlled by adjusting the amount of magnetic powder contained.

The grain size of such low density carrier particle used in the third embodiment can be determined freely but the desirable average grain size is ranged from 30 to 50 μm, from the result of experiment, and particularly the optimum average grain size is about 40 μm when increase of developing efficiency by reduction of grain size of carrier and adhesion of carrier to the latent image part by the fringe field are considered.

The magnetic brush developing device used in the developing device of the third embodiment of the present invention comprises a developing roll consisting of a magnet roll having a plurality of magnetic poles and nonmagnetic cylindrical sleeve provided at the circumference thereof and forms a magnetic brush by depositing the double-element developer on the developing sleeve of such developing roll and adjusting the magnetic brush or tipping part length with a freely selected magnetic brush limiting member and thereby realizes development through adhesion of toner to the latent image by rubbing the photosensitive medium surface provided opposed to the magnetic brush while moving the magnetic brush through the relative movement of magnet roll and sleeve. The magnetic roll is fixed and the sleeve is rotated. It is preferable that the filling rate of developer in developing nip should be ranged from 10 to 50% in the second and successive developing processes. In this case, the developing capability becomes further sufficient and sufficient developing can be realized. Furthermore, the damage on the toner image by the first developing becomes small and thereby the thickening rate of line and mixing rate of toner also become lower. Here, the "filling rate" means a filling degree of carrier of the double-element developer in the developing nip and it is expressed by the following equation.

$$D = \frac{F \times l \times d}{h \times l \times d} \cdot \frac{1}{\rho} \cdot \left| \frac{V_{Dev} - V_{PR}}{V_{PR}} \right| = \frac{F}{h} \cdot \frac{1}{\rho} \cdot \left| \frac{V_{Dev} - V_{PR}}{V_{PR}} \right|$$

In above equation,

D: filling rate (%)

l: effective developing roll length (cm)

h: distance between photosensitive medium and developing roll (cm)

F: amount of developer transferred on the developing roll (g/cm$^2$)

$\rho$: true density of carrier (g/cm$^3$)

$V_{PR}$: moving velocity of photosensitive medium (cm/sec)

$V_{Dev}$: moving velocity of developer (cm/sec).

In the third embodiment, the desired toner filling rate can be obtained by adequately selecting the above parameters.

Figure 8:
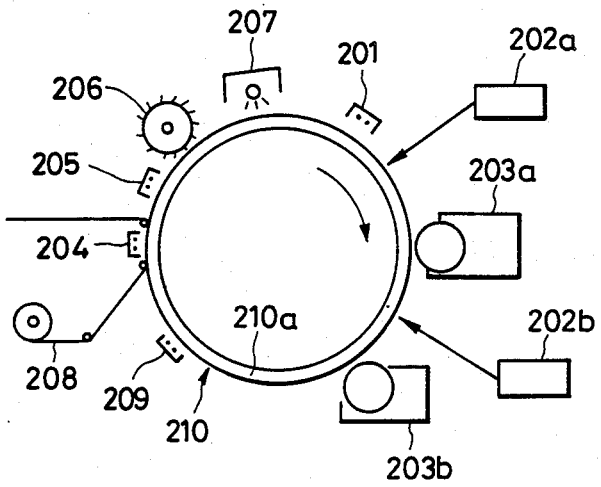
FIG. 8 shows structure of an example of a color picture recording appratus used for enforcement of the third embodiment of the presnet invention.

FIG. 8 is an example of a color picture recording apparatus used for enforcing the color image recording method of the third embodiment to form color picture through formation of 2-level latent images. In FIG. 8, 201 is a charger, **202*a* is a first exposing means, 203*a* is a first developing means, 202*b* is a second exposing means, 203*b* is a second developing means, 204 is a transfer corotoron, 205 is a preclean corotoron, 206 is a cleaner, 207 is an optical preclean, 208 is a recording paper, 209 is a pre-transfer corotoron, 210*a*** is a photosensitive layer.

The operation of the apparatus of FIG. 8 is as follows:

The photosensitive drum 210 rotates in the direction of arrow mark. First, the photosensitive layer **210*a* at the surface of photosensitive drum 210 is uniformly charged by the charger 201**.

Next, light irradiation is conducted by the first exposing means **202*a* depending on the picture information corresponding to the first color and thereby the electrostatic latent image corresponding to the first color is formed on the photosensitive medium. Any type of exposing means may be selected. Next, the first electrostatic latent image is visualized with the first developing means by supplying the toner of the first color to the photosensitive layer 210*a*** having the first electrostatic latent image formed by the first exposing means. As the first developing means, any type of developing means may be used. In this case, the developing bias is selected in accordance with the regular developing or inverse developing to be conducted.

In succession, light irradiation is conducted depending on the picture information corresponding to the second color with the second exposing means **202*b* and the electrostatic latent image corresponding to the second color is formed on the photosensitive layer 210*a*. The exposing means and writing system may be selected freely. Thereafter, the toner corresponding to the second color is then supplied to visualize the image by the second developing means 203*b* to the photosensitive layer 210*a*** having the second electrostatic latent image formed by the second exposing means. In this case, the developing bias can also be selected freely.

The pre-transfer corotoron 209 is used to match the polarities of first and second toners deposited on the photosensitive medium before transfer and it also may be omitted for the particular process. The first toner image and the second toner image are transferred by the transfer corotoron 204 on the recording paper but such transfer may also be done using the means other than the electrostatic transfer. The image is then fixed on the recording paper in the fixing part not illustrated. The photosensitive medium having passed the transfer part enters the cleaning process by the preclean corotoron 205, cleaner 206 and photo-precleaner 207 for successive use.

As the first and second exposing means, those consisting of the light irradiation means, document scanning means and optical system for focusing may be used but various kinds of devices such as the optical writing device which realizes optical modulation depending on the picture information, for example, the laser writing device, liquid crystal light valve consisting of uniform light source and liquid crystal micro-shutter or LED array, optical fiber may be used as desired considering the purposes.

In some cases, it is also possible to provide the second charging means before the second exposing means.

Experiment 3

An example of the double-element developer to be used in the third embodiment is manufactured as follows.

Carrier:

The carrier with its density of 2.9 (g/cm$^3$) and its average grain size of 40 μm was obtained by mixing the copolymer of stylene-n-butylmethacrylate (density: 1.1 g/cm$^3$) and cubic type magnetite (density: 4.8 g/cm$^3$) in the rate (weight ratio) of 20/80, then kneading melted raw materials and finally milling such materials.

Toner:

The toner with average grain size of 9.8 μm was obtained by kneading melted resin with 92 weight part obtained through graft polymer of low molecule polyolefin to the stylenebutylmethacrylate copolymer and the red color pigment (for example, resolscarlet, manufactured by BASF AG) with 8 weight part and then milling such kneaded materials.

Double-element developer:

The developer was obtained by mixing said carrier with 90 weight part and the toner with 10 weight part.

Figure 9:
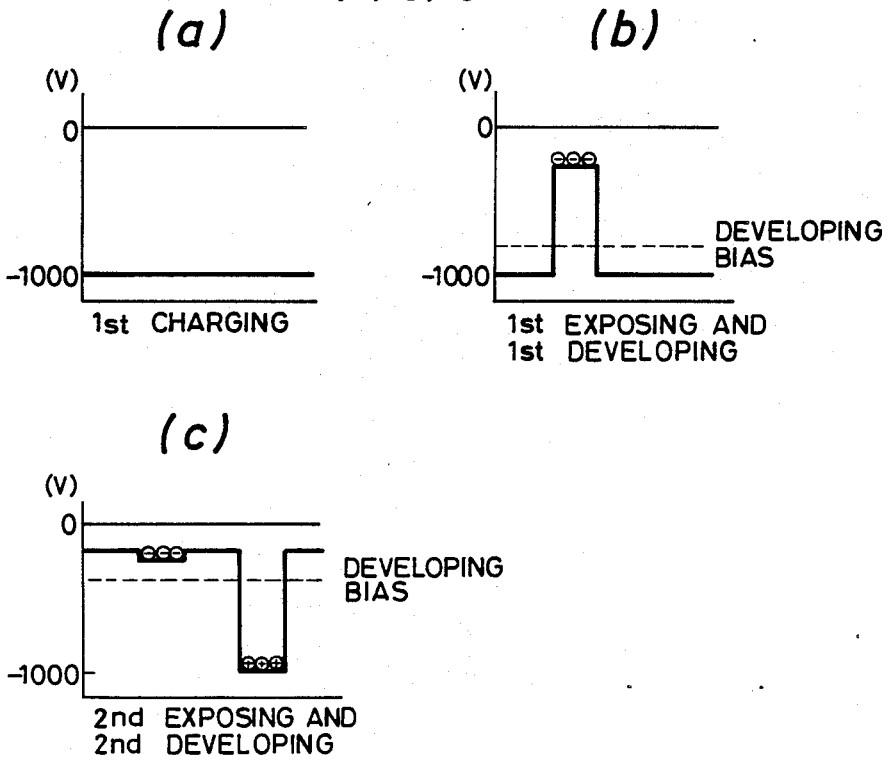
FIG. 9 indicates diagrams for explaining the surface voltage of photosensitve medium and developing conditions according to the Testing 1 in the apparatus of FIG. 8.

The testings 1 to 3 conducted with using the color picture recording apparatus shown in FIG. 8 are explained below.

by the second developing means under the developing bias of −400 V (FIG. 9(*c*)). In this case, other operating conditions were as follows.

The moving speed of photosensitive drum is set to 140 mm/sec. The developing roll used in the first developing means had the stainless steel sleeve with outer diameter of 40 mm and 8-pole symmetrical magnetizing roll with outer diameter of 20 mm. The developing roll used in the second developing means was composed of the stainless steel sleeve with outer diameter of 40 mm and the 8-pole magnetizing roll with outer diameter of 20 mm and formed repulsion field in the developing nip region.

As the developer, the double element developer consisting of the red toner and ferrite carrier particle with its density of 5.0 g/cm$^3$ and its grain size of 100 μm was used for the first developing means. The double-element developers consisting of the black toner and the following four kinds of carrier particles with their grain sizes of 40 μm were respectively used for the second developing means; (i) carrier particle with its density of 2.2 g/cm$^3$ obtained by dispersing magnetic powder into the resin as the binder, (ii) carrier particle with its density of 3.8 g/cm$^3$ obtained by dispersing magnetic powder into the resin as the binder, (iii) ferrite carrier particle with its density of 5.0 g/cm$^3$ and (iv) Fe carrier particle with its density of 7.2 g/cm$^3$.

Moreover, the moving speed ($F_{Dev}$) [cm] of developer used in the second developing means, distance (h)[cm] between the photosensitive medium and developing roll and amount of transfer of developer on the developing roll (F) [g/cm$^2$] were as indicated in Table 1. In this case, the filling rate (D) [%] of the toner was also as indicated in Table 1.

TABLE 1

| | (i) p = 2.2 (g/cm$^2$) | | | | (ii) p = 3.8 | | | | (iii) p = 5.0 | | | | (iv) p = 7.2 | | | |
|---|---|---|---|---|---|---|---|---|---|---|---|---|---|---|---|---|
| | F | h | VDev | D | F | h | VDev | D | F | h | VDev | D | F | h | VDev | D |
| Testing 1 | 0.03 | 0.09 | 70 | 8.0 | 0.05 | 0.09 | 210 | 7.3 | 0.07 | 0.09 | 210 | 7.8 | 0.08 | 0.09 | 210 | 6.2 |
| (VPR = 140 mm/sec) | 0.05 | 0.09 | 210 | 12.6 | 0.05 | 0.09 | 280 | 14.6 | 0.13 | 0.12 | 210 | 10.8 | 0.08 | 0.09 | 280 | 12.3 |
| | 0.03 | 0.09 | 280 | 15.0 | 0.10 | 0.10 | 280 | 26.3 | 0.07 | 0.09 | 280 | 15.6 | 0.15 | 0.10 | 280 | 20.8 |
| | 0.05 | 0.09 | 280 | 25.3 | 0.11 | 0.09 | 280 | 32.2 | 0.13 | 0.12 | 280 | 21.7 | 0.15 | 0.09 | 280 | 23.1 |
| | 0.08 | 0.10 | 280 | 36.4 | 0.10 | 0.10 | 420 | 52.6 | 0.13 | 0.10 | 280 | 26.0 | | | | |
| | 0.05 | 0.09 | 420 | 50.5 | 0.11 | 0.09 | 420 | 64.3 | 0.07 | 0.09 | 420 | 31.2 | | | | |
| | 0.08 | 0.10 | 420 | 72.8 | | | | | | | | | | | | |
| Testing 2 | 0.03 | 0.09 | 80 | 8.0 | 0.05 | 0.09 | 240 | 7.2 | 0.07 | 0.09 | 240 | 7.8 | 0.08 | 0.09 | 240 | 6.2 |
| (VPR = 160 mm/sec) | 0.05 | 0.09 | 240 | 12.6 | 0.05 | 0.09 | 320 | 14.6 | 0.13 | 0.12 | 240 | 10.8 | 0.08 | 0.09 | 320 | 12.3 |
| | 0.03 | 0.09 | 320 | 15.0 | 0.10 | 0.10 | 320 | 26.4 | 0.07 | 0.09 | 320 | 15.6 | 0.15 | 0.10 | 320 | 20.8 |
| | 0.05 | 0.09 | 320 | 26.0 | 0.11 | 0.09 | 320 | 32.2 | 0.13 | 0.12 | 320 | 21.7 | 0.15 | 0.09 | 320 | 23.1 |
| | 0.08 | 0.10 | 320 | 36.4 | 0.10 | 0.10 | 480 | 52.6 | 0.13 | 0.10 | 320 | 26.0 | | | | |
| | 0.05 | 0.09 | 480 | 52.0 | 0.11 | 0.09 | 480 | 64.3 | 0.07 | 0.09 | 480 | 31.2 | | | | |
| | 0.08 | 0.10 | 400 | 54.5 | | | | | | | | | | | | |
| | 0.08 | 0.10 | 450 | 65.9 | | | | | | | | | | | | |

Testing 1

As the photosensitive drum, the drum made of the organic photoconductive material with outer diameter of 84 mm was used. The drum was charged uniformly to −1000 V by the charger (FIG. 9(*a*)). Next, the inverse exposing (exposing of picture part) was carried out using the He-Ne laser to form the electrostatic latent image having the surface voltages of −300 V for the exposed part and −1000 V for the non-exposed part, and developing was conducted using the red color toner by the first developing means under the developing bias of −800 V (FIG. 9(*b*)). Thereafter, the regular exposing (exposing of non-picture part) was carried out by the exposing lamp to form the electrostatic latent image having the surface voltage of −1000 V for non-exposing part and −200 V for exposing part, and such latent image was developed using the black color toner Here, amount of transfer of developer used in the second developing means was changed by adjustment of trimmer gap.

Figure 10:
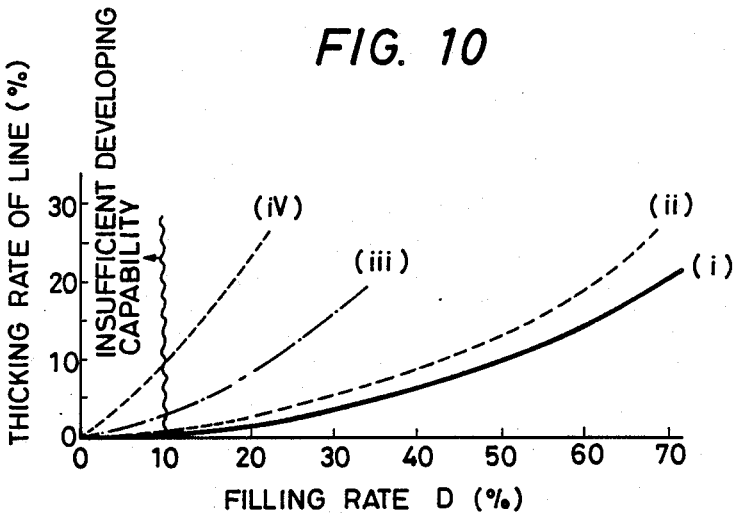
FIG. 10 is a graph indicating the relationship between the filling rage of developer and thicking rate of line according to the Testing 1.
Figure 11:
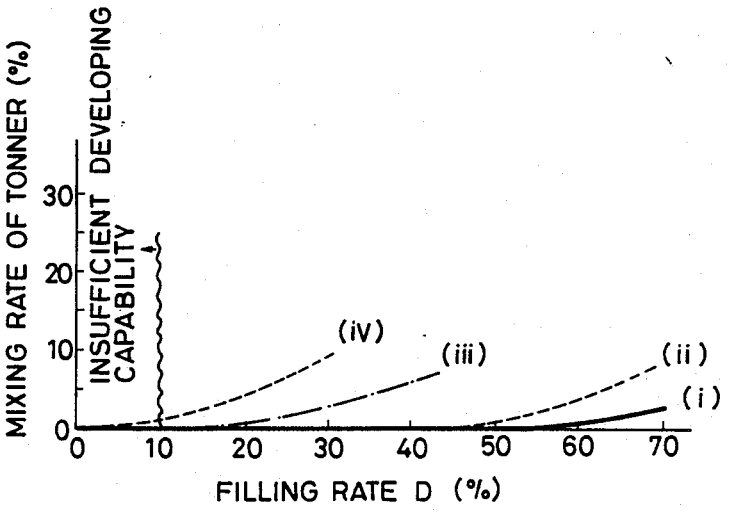
FIG. 11 is a graph indicating the relationship between the filling rate of developer and toner mixing rate according to the Testing 1.

FIG. 10 and FIG. 11 indicate the results of testings conducted with the filling rate of developer within the developing nip in the second developing means. In these figures, the thickening rate of line and mixing rate of toner are evaluated in accordance with the following equations.

Thickening rate (blur rate of line) (%) = 1

-continued $$\frac{\{(\text{line width of toner image of first developing after passing second developing nip}) - (\text{line width of toner image of first developing before passing second developing nip})\}}{(\text{line width of toner image of first developing before passing second developing nip})} \times 100$$

$$\text{Mixing rate of toner (weight \%)} = \frac{\{(\text{weight of toner of first developing}) - (\text{weight of toner of first developing after passing second developing nip})\}}{(\text{weight of toner of first developing})} \times 100$$

Testing 2

The processings were the same as those in the Testing 1, except that the double-element developer consisting of the red color toner and carrier particle with its density of 2.2 g/cm$^3$ and its grain size of 40 μm obtained by dispersing magnetic powder into the binder resin was used as the developer in the first developing means. The result obtained was similar to that of Testing 1.

Testing 3

Figure 12:
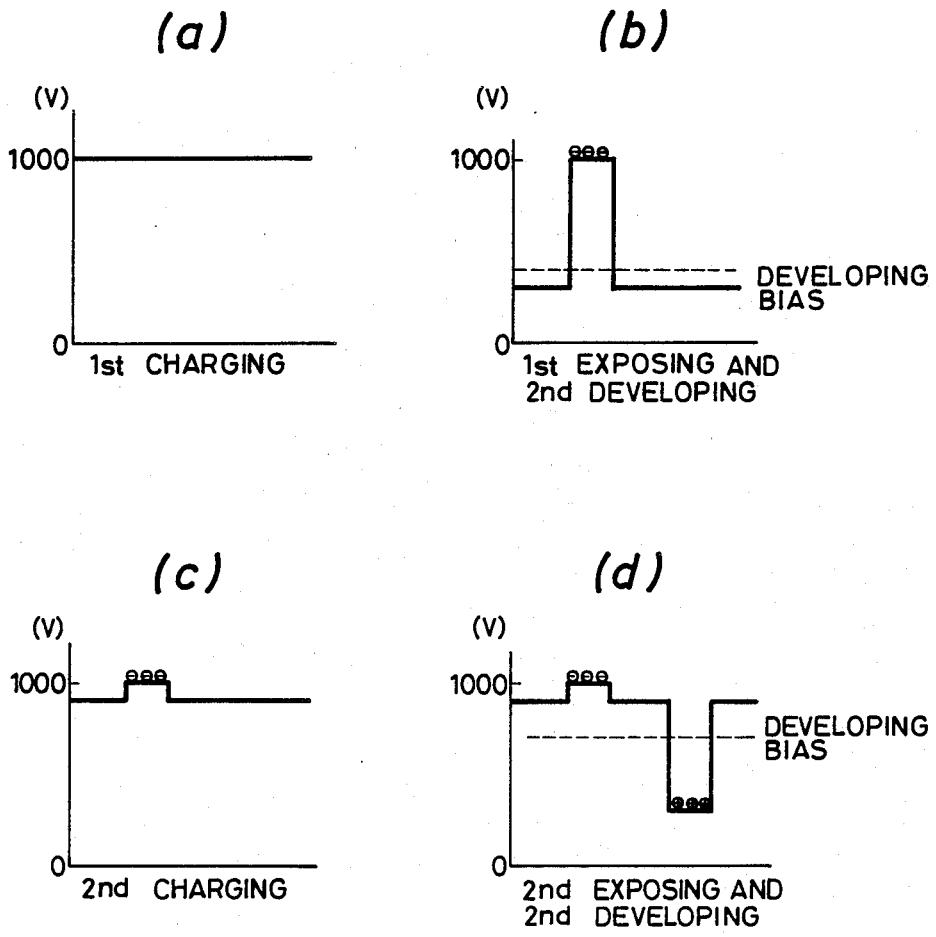
FIG. 12 indicates diagrams for explaining the surface voltage of photosensitive medium and developing condition according to the Testing 3 in the apparatus of FIG. 8.

A Se system drum with outer diameter of 84 mm was used a photosensitive drum and it is uniformly charged to 1000 V with a charger (FIG. 12(*a*)). Next, the regular exposing (exposing of the non-picture part) was conducted with an exposing lamp to form an electrostatic latent image having the surface voltages of 300 V for exposing part and 1000 V for non-exposing part. This latent image was then developed using the red color toner with the first developing means under the developing bias of 400 V (FIG. 12(*b*)). While, the polarity of toner was kept to negative with the second charging means, the drum was charged uniformly by the voltage 900 V (FIG. 12(*c*)). The drum was then exposed reversely (exposing of picture part) by LED to form electrostatic latent image having the surface voltages of 900 V for non-exposing part and 200 V for exposing part. Such latent image was developed using black color toner with the second developing means under the developing bias of 700 V (FIG. 12(*d*)). In this case, other processing conditions were as follows.

The moving speed of photosensitive drum was set to 160 mm/sec. The developing roll consisting of the stainless steel sleeve with outer diameter of 40 mm and the 8-pole symmetrical magnetizing roll with outer diameter of 25 mm was used in the first developing means. The roll consisting of the stainless steel sleeve with outer diameter of 40 mm and the 8-pole magnetizing roll with outer diameter of 20 mm and forming repulsion magnetic field in the developing nip region was used in the second developing means.

On the other hand, the double-element developer consisting of the black color toner and the ferrite system carrier particle with its density of 5.0 g/cm$^3$ and its grain size of 100 μm was used in the first developing means, while the double-element developer consisting of the red color toner and the same carrier particle as that used in the Testing 1 was used in the second developing means.

The moving speed ($F_{Dev}$) [cm] of developer used in the second developing means, distance (h) [cm] between the photosensitive medium and developing roll and amount of transfer of developer on the developing roll (F) [g/cm$^2$] were as indicated in Table 1. In this case, the filling rate (D) [%] of the toner was also as indicated in Table 1.

Amount of developer transferred in the second developing means was changed by adjusting trimmer gap.

Figure 13:
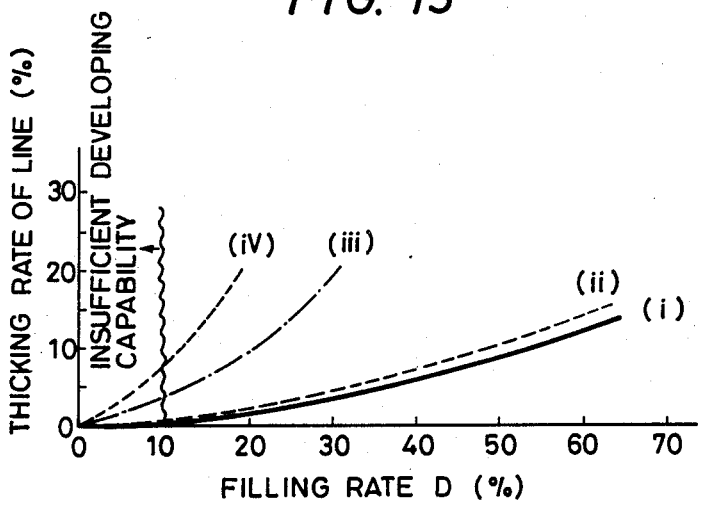
FIG. 13 is a graph indicating the relationship between the filling rate of developer and thicking rate of line according to the Testing 3.
Figure 14:
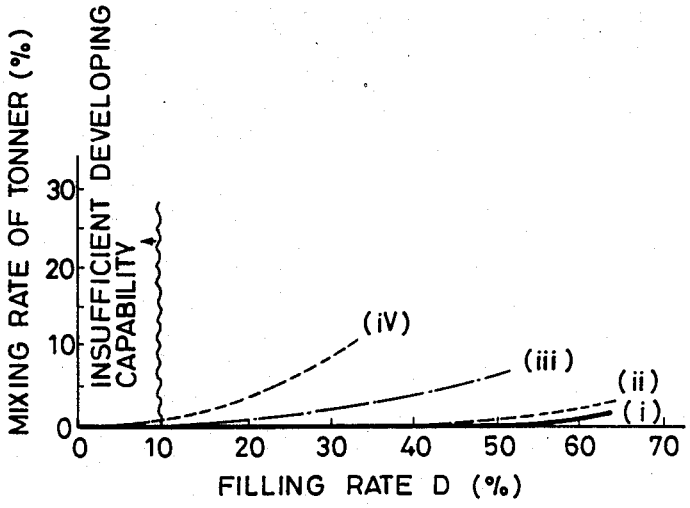
FIG. 14 is a graph indicating the relationship between the filling rate of developer and mixing rate of toner in the Testing 3.

FIG. 13 and FIG. 14 indicate the results of testings conducted with changing the filling rate of developer within the developing nip in the second developing means. In these figures, the thickening rate of line and mixing rate of toner are evaluated in accordance with the already explained equations.

From above result, it is obvious that the developer filling rate in the developing nip in the second developing means should preferably be within the range from 10 to 50%, and that the carrier in the developer should have the density equal to or less than 4.0 g/cm$^3$ and should be formed from dispersing magnetic powder into the binder resin. In this case, the toner image is not damaged and mixing of toner and disturbance of toner image can be controlled.

According to the color picture recording method of the third embodiment of the present invention in which the repeated developing is carried out by the magnetic brush method using the double-element developer, since the developer filling rate in the developing nip of the second developing means is set to the range from 10 to 50%, the toner image in the preceding stage is neither disturbed even during the repeated developing and the carry over phenomenon is nor generated. Therefore, the present invention provides high quality color picture without disturbance.

The fourth embodiment of the present invention will be described with reference to FIGS. 15 to 19. The fourth embodiment is a color picture recording method, to which the present invention is applied.

A color picture recording method of the fourth embodiment of the present invention comprises a latent image forming process to form electrostatic latent image on the latent image carrier with a latent image forming means, a developing process to visualize formed latent image with the toners in two or more different colors and a transfer process for transferring visualized color toner image after repeating several times at least the developing process of said latent image forming process and developing process, wherein a developing roll, consisting of a developing sleeve and magnet roll and having the magnetizing pattern in which the magnetic poles of the same polarity are adjacent in the developing nip region and the magnetic flux density of main pole for developing of 500 Gauss or more, is used at least in the developing processes at the second and the following trials among plural times of developing processes, and developing is conducted by depositing the double-element developer consisting of the toner and magnetic carrier with its density of 4.0 g/cm$^3$ or less on said developing sleeve.

The grain size of such low density carrier particle used in the present invention can be determined freely but the desirable average grain size is ranged from 30 to 50 μm, from the result of experiment, and particularly the optimum average grain size is about 40 μm.

Figure 17:
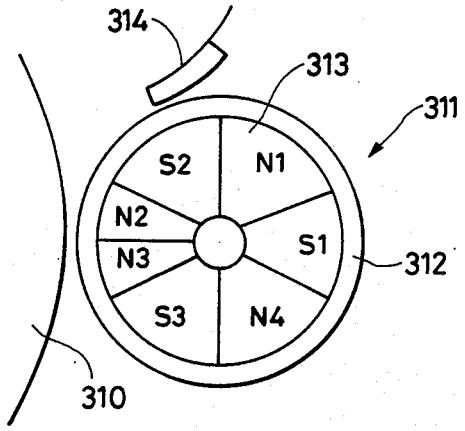
FIG. 17 shows structure of an example of the developing roll used in the fourth embodiment.
Figure 18:
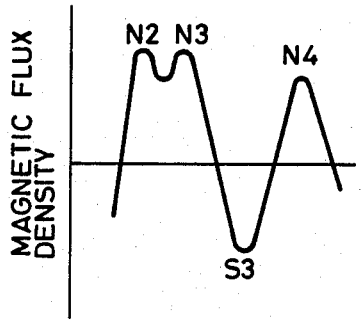
FIG. 18 is a graph indicating magnetic flux density of the developint roll of FIG. 17.

The magnetic brush developing device used in the developing process in the fourth embodiment of the present invention provides the developing roll consisting of the magnetic roll having a plurality of magnetic poles and non-magnetic cylindrical sleeve provided to the circumference thereof. The developing roll at least in the second or successive developing processes should preferably have the magnetizing pattern in which the magnetic poles of the same polarity are adjacent in the developing nip and has the magnetic flux density of main pole for developing of 500 Gauss or more. Moreover, it is also desirable for the developing roll to have the level difference of 200 Gauss or more between the maximum and minimum levels in the distribution of magnetic flux of the main pole for developing and it is particularly desirable to have the level difference of 350 to 500 Gauss. An example thereof is indicated in FIG. 17. In this FIG. 17, the developing roll 311 is composed of a developing sleeve 312 made of non-magnetic material and a magnet roll 313 and has non-symmetrical 7-pole magnetizing pattern and it is provided opposed to the photosensitive drum 310. The main poles for developing are consisting of N2 and N3 which are adjacent to each other and form he repulsion magnetic field as indicated in FIG. 18 in the developing nip region. 314 is the magnetic brush or tipping part limiting member.

The magnetic brush is formed by depositing the double-element developer on the developing sleeve of such developing roll and adjusting the magnetic brush or tipping part length with a freely selected magnetic brush limiting member and the developing is realized through adhesion of toner to the latent image by rubbing the photosensitive medium surface provided opposed to the magnetic brush while moving the magnetic brush through the relative movement of magnet roll and sleeve. In this case, the magnet roll is fixed and the sleeve is rotated, and it is desirable that the moving speed of surface is set equal to that of the photosensitive medium, namely of the latent image carrier surface.

Figure 15:
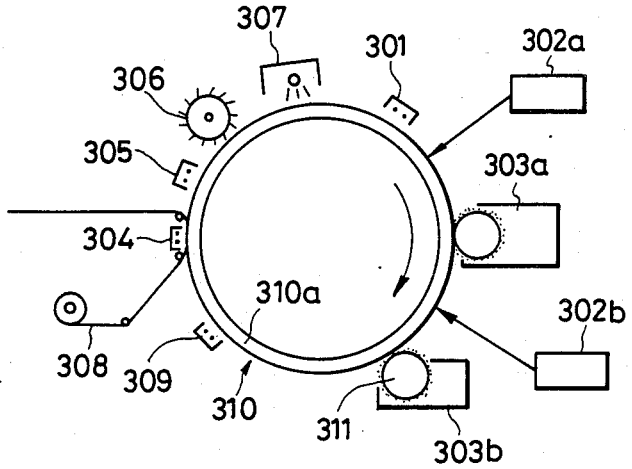
FIG. 15 shows structure of an example of a color picture recording apparatus used for enforcement of the fourth embodiment.
Figure 16:
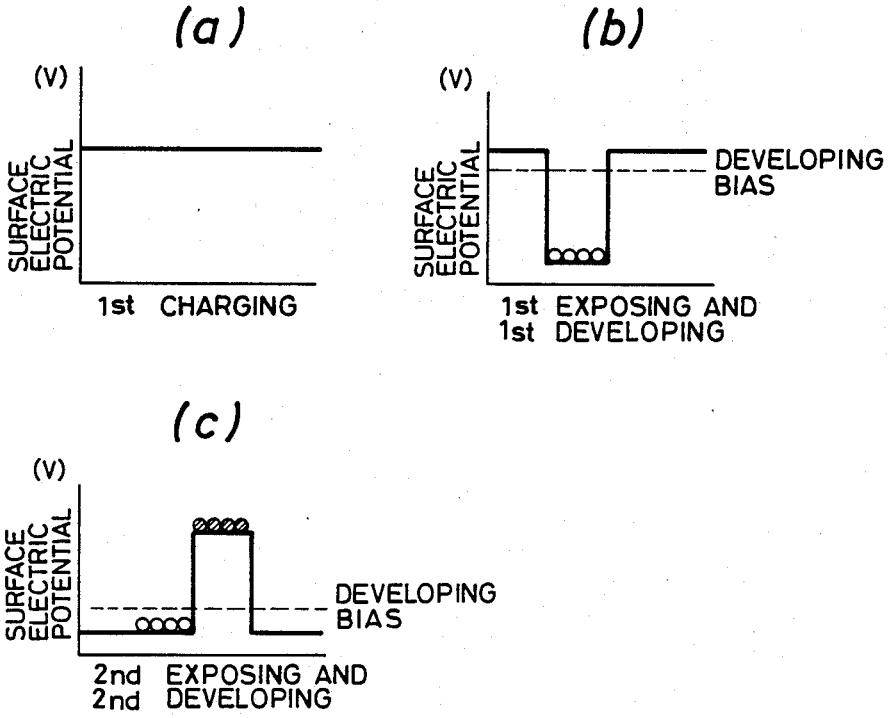
FIG. 16 indicates diagrams for explaining the surface voltage of photosensitive medium and developing conditions when the color picture recording apparatus of FIG. 15 is operated.

FIG. 15 is an example of a color picture recording apparatus used for enforcment of the image recording method of the fourth embodiment, in which the color picture is formed by formation of latent image of two levels. FIG. 16 indicates the diagrams for explaining surface voltage of photosensitive medium and developing condition in case the color picture recording apparatus of FIG. 15 is operated. In FIG. 15, 301 is a charger, 302 is a first exposing means, 303*a* is a first developing means, 302*b* is a second exposing means, 303*b* is a second developing means, 304 is a transfer corotoron, 305 is a preclean corotoron, 306 is a cleaner, 307 is an optical preclean, 308 is a recording paper, 309 is a pre-transfer corotoron, 310*a* is a photosensitive layer.

The operation of the apparatus of FIG. 15 is as follows:

The photosensitive drum 310 rotates in the direction of arrow mark. First, the photosensitive layer 310*a* at the surface of photosensitive drum 310 is uniformly charged by the charger 301. (FIG. 16(*a*)).

Next, light irradiation is conducted by the first exposing means 302*a* depending on the picture information corresponding to the first color and thereby the electrostatic latent image corresponding to the first color is formed on the photosensitive medium. Any type of exposing means may be selected. Next, the first electrostatic latent image is visualized with the first developing means by supplying the toner of the first color to the photosensitive layer 310*a* having the first electrostatic latent image formed by the first exposing means. (FIG. 16(*b*)) As the first developing means, any type of developing means may be used. In this case, the developing bias is selected in accordance with the regular developing or inverse developing to be conducted.

In succession, light irradiation is conducted depending on the picture information corresponding to the second color with the second exposing means 302*b* and the electrostatic latent image corresponding to the second color is formed on the photosensitive layer 310*a*. The exposing means and writing system may be selected freely. Thereafter, the toner corresponding to the second color is then supplied to visualize the image by the second developing means 303*b* to the photosensitive layer 310*a* having the second electrostatic latent image formed by the second exposing means. (FIG. 16(*c*)) In this case, the developing bias can also be selected freely.

The pre-transfer corotoron 309 is used to match the polarities of first and second toners deposited on the photosensitive medium before transfer and it also may be omitted for the particular process. The first toner image and the second toner image are transferred by the transfer corotoron 304 on the recording paper but such transfer may also be done using the means other than the electrostatic transfer. The image is then fixed on the recording paper in the fixing part not illustrated. The photosensitive medium having passed the transfer part enters the cleaning process by the preclean corotoron 305, cleaner 306 and photo-precleaner 307 for successive use.

As the first and second exposing means, those consisting of the light irradiation means, document scanning means and optical system for focusing may be used but various kinds of devices such as the optical writing device which realizes optical modulation depending on the picture information, for example, the laser writing device, liquid crystal light bulb consisting of uniform light source and liquid crystal micro-shutter or LED array, optical fiber may be used as desired considering the purposes.

In some cases, it is also possible to provide the second charging means before the second exposing means.

Experiment 4

An example of the double-element developer to be used in the fourth embodiment is manufactured as follows.

Carrier:

The carrier with its density of 2.9 (g/cm$^3$) and its average grain size of 40 μm was obtained by mixing the copolymer of stylene-n-butylmethacrylate (density: 1.1 g/cm$^3$) and cubic type magnetite (density: 4.8 g/cm$^3$) in the rate (weight ratio) of 20/80, then kneading melted raw materials and finally milling such materials.

Toner:

The toner with average grain size of 9.8 μm was obtained by kneading melted resin with 92 weight part obtained through graft polymer of low molecule polyolefin to the stylenebutylmethacrylate copolymer and the red color pigment (for example, resolscarlet, manufactured by BASF AG) with 8 weight part and then milling such kneaded materials.

Double-element developer:

The developer was obtained by mixing the carrier with 90 weight part and the toner with 10 weight part.

The testings conducted with using the color picture recording apparatus shown in FIG. 15 are explained below.

As the photosensitive drum, the Se system drum was used and it was then charged uniformly to 1100 V by the charger. Next, the inverse exposing (exposing of picture part) was carried out using the He-Ne laser to form the electrostatic latent image having the surface voltages of 200 V for the exposed part and 800 V for the non-exposed part and developing was conducted using the red color toner by the first developing means under the developing bias of 650 V. Thereafter, the regular exposing (exposing of non-picture part) was carried out by the exposing lamp to form the electrostatic latent image having the surface voltage of 750 V for non-exposing part and 100 V for exposing part, and such latent image was developed using the black color toner by the second developing means under the developing bias of 250 V. In this case, other operating conditions are as follow.

The surface line moving speed of photosensitive drum was set to 50 mm/sec. The carrier of the double-element developer used by the first and second developing means was obtained by dispersing the magnetic powder into the binder resin and has the density of 3.0 g/cm$^3$ and average grain size of 40 $\mu$m.

The developing roll in the first developing means was the 6-pole symmetrical magnetization roll and the magnetic flux density of main pole magnet was 800±50 Gauss. Meanwhile, the developing roll in the second developing means was the non-symmetrical 7-pole magnetizing roll indicated in FIG. 17 and its surface moving line speed was 50 mm/sec. The surface magnetic flux density of main pole magnet of the developing roll of the second developing means, N2, N3=1200±50 Gauss and level difference between the maximum and minimum levels formed by N2 and N3 were 500 Gauss. The magnetic flux density of other poles is 800±500 Gauss. (Test 1)

For comparison, the testing was conducted in the same way as explained above, except for that the iron system carrier with density of 7.8 g/cm$^3$ and average grain size of 60 $\mu$m as the carrier of double-density developer used in the second developing means. (Test 2)

Figure 19:
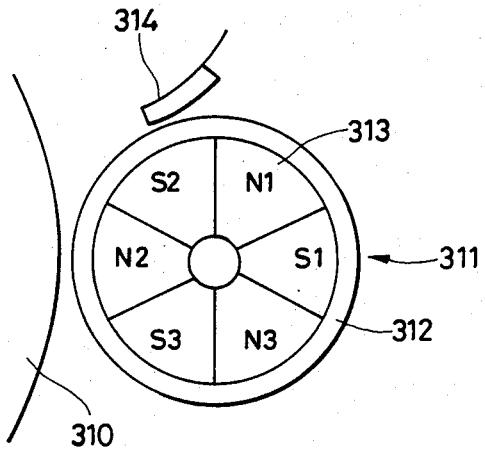
FIG. 19 shows structure of the developing roll generally used for developing device.

Moreover, the testing was conducted in the same way as explained above, except that the iron system carrier with density of 7.8 g/cm$^3$ and average grain size of 60 $\mu$m was used as the double-element developer carrier, the 6-pole symmetrical magnetization developing roll (the surface magnetic flux density of main pole magnet N2=800±50 Gauss) indicated in FIG. 19 was used as the developing roll in the second developing means and the surface moving line speed of developing roll was set to 150 mm/sec. (In this case, the developing roll speed was increased so that the similar developing concentration to that of the repulsion magnetic field can be obtained ×3) (Test 3)

In addition, the testing was conducted in the same way as the Test 1, except that the surface magnetic flux density of main pole magnet of the developing roll in the second developing means, N2, N3, were 300±50 Gauss and the level difference between the maximum and minimum levels formed by N2 and N3 was 100 Gauss. (Test 4)

The results of these tests are indicated in the following table. In this table, the circle O means NO(not exist), the cross × means YES(exist) and the triangle Δ means possibility to practical use but not preventing picture quality from being detriorated.

| Test No. | Deterioration of picture of 1st developing: Disturbance of picture | Deterioration of picture of 1st developing: Deterioration of picture concentration | Deterioration of picture concentration of 2nd developing |
|---|---|---|---|
| 1 | | | |
| 2 | | Δ | |
| 3 | Δ | × | |
| 4 | | | Δ |

As is obvious from the result indicated in above table, deterioration of developing capability may be prevented and the operation of scratching the toner image already formed may also be reduced by using the developing roll, in the second developing process, which has the repulsion magnetic poles in the developing nip region. In this case, it is preferred that the magnetic flux density of repulsion poles in the developing nip should be 500 Gauss or more and sufficient developing capability can be attained in case the level difference between the maximum and minimum levels in the magnetic flux distribution in the developing nip is 200 Gauss or more. It can also be understood that deterioration of toner image by the first developing may be remarkably reduced by using, in combination with the developing roll, the double-element developer containing the magnetic carrier with its density of 4.0 g/cm$^3$ or less.

According to the color picture recording method of the fourth embodiment of the present invention in which the repeated developing is conducted by the magnetic brush method utilizing said developing roll and double-element developer, the toner image in the preceding stage is not disturbed even in the repeated developing and carry over phenomenon is not generated. Accordingly, the color picture in high quality without any disturbance of picture may be obtained by the present invention.

The image recording method of the present invention described with the first through the fourth embodiments can be applied to the fifth embodiment shown in FIGS. 20 to 23.

The fifth embodiment of the present invention is color recording method characterized in that the first charging process is conducted to a photosensitive medium, a first electrostatic latent image is formed by exposing the photosensitive medium, a first toner image is formed by developing the electrostatic latent image, a second electrostatic latent image is formed by exposing the toner image on the photosensitive medium and this second latent image is developed using the toner of the color different from the color of the first toner image under the relationship of respective voltages of $|V_b-V_c| \geqq |V_a-V_c|$ where $V_a$ is non-picture part voltage, $V_b$ is first toner image voltage and $V_c$ is developing bias voltage of second developing device.

In above method, the photosensitive medium is first charged and it is exposed to form the first electrostatic latent image. This latent image is developed to form the first toner image. Moreover, the second electrostatic latent image is formed by the second exposing. In this case, the operating conditions of respective parts of apparatus are previously set so that voltage difference between the first toner image voltage $V_b$ and the developing bias $V_c$ of the second developing device is higher than the voltage difference between the non-picture part voltage $V_a$ and voltage $V_b$ of the first toner image. Thereby, the electrostatic adhesive force to the photosensitive medium of the tonner is enhanced and the first tonner is no longer scratched out easily by the second developing device.

Figure 21:
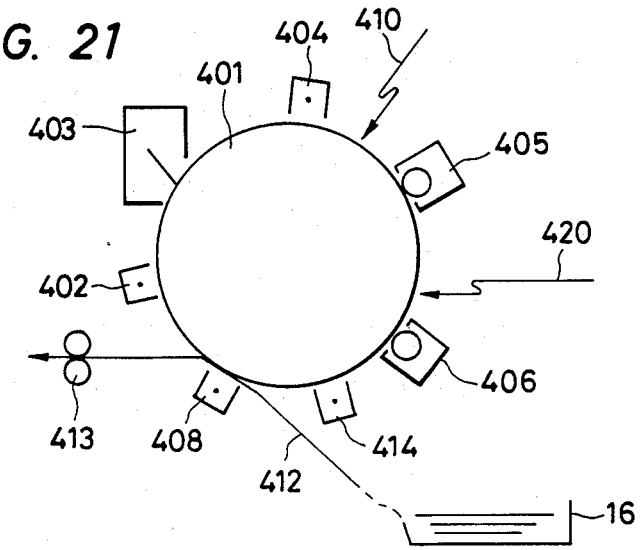
FIG. 21 shows structure of a recording apparatus which is suitable for enforcement of the color recording method of the fifth embodiment of the present invention.

FIG. 21 shows an example of the apparatus which is suitable to enforcement of a color recording method of the fifth embodiment.

This apparatus arranges a preclean corotoron 402, a cleaning device 403, a charger 404, a first developing device 405, a second developing device 406, a pre-transfer corotoron 414 and a transfer device 408 at the external circumference of the photosensitive medium 401. Moreover, the first exposing part 410 is provided between the first charger 404 and the first developing device 405, and the second exposing part 420 between the first developing device 405 and the second developing device 406. The recording paper 412 is sent from the paper feed tray 416, passes between the transfer device 408 and the photosensitive medium 401 and is exhausted through the fixing device 413.

The first exposing part 410 and second exposing part 420 of this apparatus use the so-called optical focusing system using the mirror and lens system and so-called optical writing device such as the laser diode array, light emitting diode array, liquid crystal shutter array and fluorescent lamp display element array, etc.

An example of the color recording system of the fifth embodiment is explained with reference to FIG. 20.

In this figure, the alphabets a to e indicate changes of voltage in respective portions of photosensitive medium in the method of the fifth embodiment. Moreover, the recorded picture contains the white region (W), black region (B) and red region (R) as indicated in the upper part of figure.

First, the photosensitive medium 401 is uniformly charged by the first charger 404 (FIG. 20*a*).

Next, the photosensitive medium 401 is negatively exposed by the first exposing part 410. Thereby, the photosensitive medium 401 is discharged up to the voltage V1 in the region corresponding to the black region B. The red region R is kept at the initially charged voltage V0 (FIG. 20*b*).

Next, a developing bias V2 is set between the electrostatic latent image voltage V1 of black region B and the initially charged voltage V0 and developing is carried out using the positively charged black color toner with the first developing device 405 (FIG. 20*c*).

Figure 20:
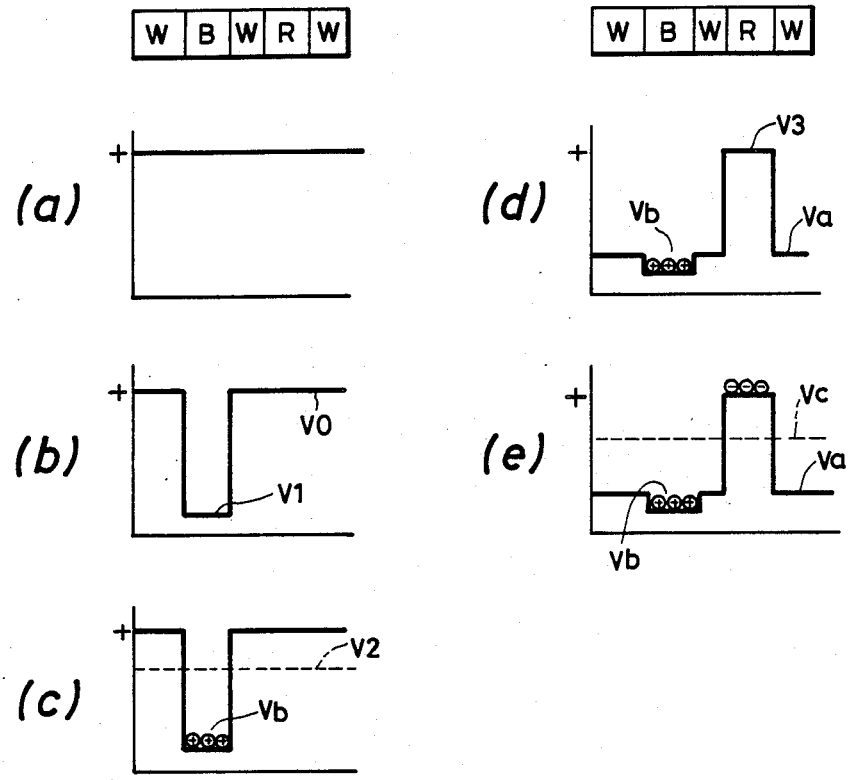
FIG. 20 indicates diagrams for explaining voltages of respective portions of the photosensitive medium indicating an example of the color recording method of the fifth embodiment.

Thereafter, the second electrostatic latent image corresponding to the red region R is formed by positive exposing at the second exposing part 420 (FIG. 20*d*). In this case, the region other than the red region R is discharged up to the rather negative side than the voltage Vb of the surface of first toner image. The voltage after the discharging is called the non-picture part voltage $V_a$. It is then developed using the negatively charged red toner by the second developing device 406 (FIG. 20). In this case, the developing bias voltage $V_c$ of the second developing device is set to the intermediate voltage of the non-picture part voltage $V_a$ and electrostatic latent image voltage V3 of the red region R. Thereby, the double-color toner images are formed on the photosensitive medium 1 and these toner images are transferred to the recording paper 412 at a time. Before this transfer, both black toner and red toner are charged in the same polarity by the pre-transfer corotoron 414.

This method does not allow lowering of the copying speed and of course does not require high accuracy registration.

Advantages obtained by the method of the fifth embodiment indicated in FIGS. 20*a* to 20*e* will be explained on the basis of the results of experimental test.

Figure 22:
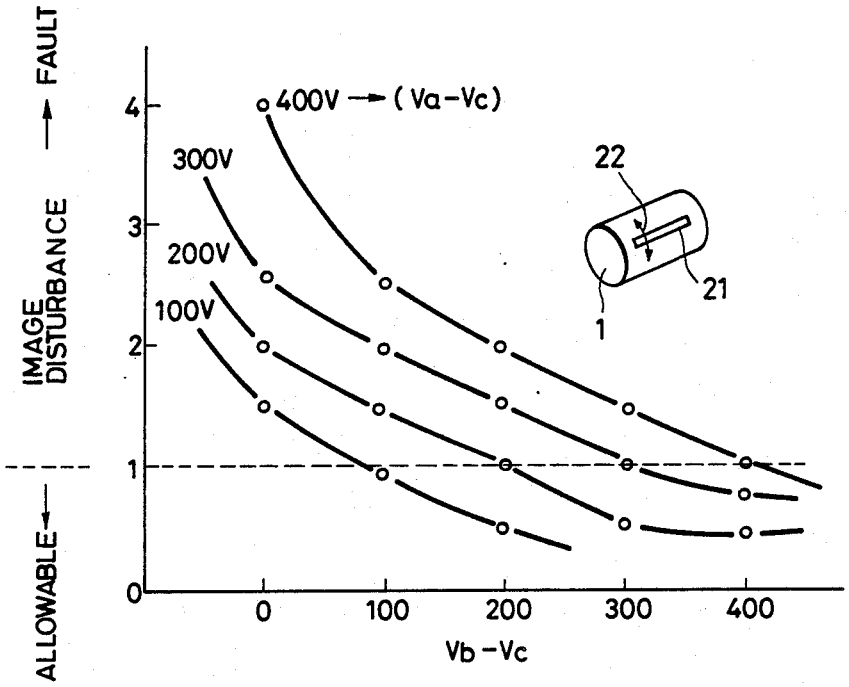
FIG. 22 is a graph for evaluating the effect of the fifth embodiment.

FIG. 22 shows the result of evaluation for disturbance of the first tonner image with adequate ranks after a belt-shaped first tonner image 421 is formed on the photosensitive medium 401 in the direction parallel to its rotating axis and it is sent to the second developing device. Disturbance of image appears mainly in the circumferencial direction (direction of the arrow 422) of the photosensitive medium. However, in case the rotating speed of developing brush of the second developing device is higher than the circumferencial speed of the photosensitive medium, the image is disturbed in the forward direction and in case the rotating speed is lower than said circumferencial speed, the image is disturbed in the backward direction.

The evaluation ranks are determined as follow: no-disturbance is ranked as "0", rather allowable disturbance as "1" and fault as "2" or more.

In the graph of FIG. 22, image disturbance is evaluated by changing a value of $|V_a-V_c|$ for the four kinds of conditions from 100 V to 400 V of a value of $|V_b-V_c|$. In this evaluation experiment, the first charging voltage was set to +800 V, the first developing bias to +650 V, the second developing bias to +400 V, and the non-picture part voltage $V_a$ was changed by changing the amount of second exposing.

From the vertical axis, the range of which evaluation is "1" or less (the range where picture is good) satisfies the conditions $|V_b-V_c| \geqq V_a-V_c|$. Namely, it means, as explained earlier, that the charging voltage and exposing voltage should preferably be selected so that the relation of FIG. 1*e* may be obtained. This is because an electrostatic attracting force to the photosensitive medium of toner is thereby enhanced and when the first tonner image enters the second developing device, the phenomenon that such tonner image is captured by the developing brush and it is then developed again is no longer generated easily under said conditions.

In the case of example

Photosensitive medium
- Selen system photosensitive medium
- Drum diameter: 200 mm First developer
- Double-element system (positively charged black tonner)
  - Carrier: Ferrite system carrier with average grain size of 100 μm
  - Black tonner: Stylene-n-butylmethacrylate copolymer of 92 part, carbon black #4000 (Mitsubishi Kasei) of 8 part and the charging control agent (Bontron P-51, Orient Chemicals) of 2 part are mixed, melted and kneaded. Thereafter this material is milled into the fine particle with average grain size of 12 μm. It is charged positively for the carrier.

Second developer
- Double-element system (negatively charged red tonner)
  - Carrier: Styrene-n-butylmethacrylate copolymer of 35 part and magnetite of 65 part are mixed, melted and kneaded. Thereafter this material is milled. Magnetic powder dispersion type. Average grain size is 30 μm with density of 2.2 g/cm$^3$.
  - Red tonner: Styrene-n-butylmethacrylate copolymer of 92 part, red color pigment resolcarlet (BASF) of 8 part and charging control agent (E-84, Orient Chemicals) of 2 part are mixed, melted and kneaded. Thereafter, this material is milled into the particle with average grain size of 12 μm. It is charged negatively for the carrier.

Process speed: 150 mm/sec

Developing parameter (First developing device, second developing device)

TG (trimming gap): 0.9 mm

DRS (drum roll space): 1.0 mm

MSA (magnetic pole inclination): +5°

Vd (developing roll rotating speed): 450 mm/sec

Main pole of magnetic poles: 650 G

Rotation of developing roll: WITH (forward direction with the photosensitive medium)

In the above description, the photosensitive medium is positively charged by each charger but the similar effect can also be obtained by using the photosensitive medium to be charged negatively.

Moreover, the developing system of each developing device may respectively be selected freely.

For example, the nega-posi exposing method is employed in the above description but the similar effect can also be attained by the posi-nega exposing, posi-posi exposing and nega-nega exposing method.

Figure 23:
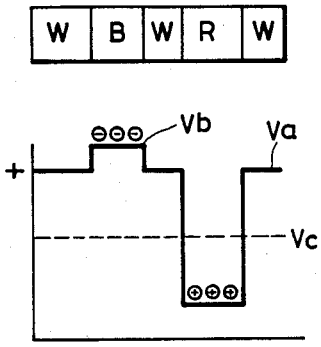
FIG. 23 indicates the diagram for explaining voltages of respective portions of photosensitive medium indicating another exmaple of the fifth embodiment.

FIG. 23 shows another example of the color recording method of the fifth embodiment utilizing the positive-negative exposing method.

In this case, after the positive exposing and the developing, the photosensitive medium is once uniformly charged before the negative exposing to set the nonpicture part voltage $V_a$. In comparison of the developing bias $V_c$ of the second developing device and voltage of each part, FIG. 23 satisfies the relationship, $|V_b-V_c| \geqq |V_a-V_c|$. From this fact, disturbance of tonner image may be further prevented by setting the voltages of respective portions as indicated in FIG. 23.

According to the color recording method of the fifth embodiment explained earlier, the first tonner image cannot enter the second developing device to come into contact with the developing brush. Therefore, disturbance of image can be prevented effectively. Migration of tonner and missing of recorded picture may be prevented thereby and high speed and high quality color recording may be realized.

Furthermore, the image recording method of the present invention also can be applied to the sixth embodiment shown in FIGS. 24 to 30. The sixth embodiment of the present invention will be described hereinafter.

The sixth embodiment is the copying apparatus comprising a picture reading device which reads picture on an original document and converts it into electrical picture signal, an optical output device which forms a first electrostatic latent image, corresponding to the particular color element signal in the picture signal, on a photosensitive medium using the output signal of the picture reading device, an optical focusing system which guides an optical image, corresponding to a color element other than the particular color in the picture on the original document, to the photosensitive medium and thereby forms a second electrostatic latent image, a first developing device which develops the first electrostatic latent image with the tonner of the first color, a second developing device which develops the second electrostatic latent image with the tonner of a color other than the first color, and a transfer device which transfers the tonner on a copying paper after developing by the first developing device and second developing device, in which the optical focusing system comprises a mirror and a lens to guide the optical image of the freely selected copying magnification to the photosensitive medium, the light being divided into two directions after passing through the lens, the one light beam entering the picture reading device, the other light beam entering the photosensitive medium to form the second electrostatic latent image after passing the optical focusing system, and a filter which allows the particular color to pass therethrough, the filter being provided movably away from and into the incident optical path to the picture reading device.

In the description, the optical focusing system means such analog optical system as a device to guide directly the optical images to the photosensitive medium with using mirror and lens.

The copying apparatus forms electrostatic latent images on a photosensitive medium using an optical output device for the particular color and an optical focusing system for the colors other than said particular color. These electrostatic latent images are respectively developed by individual developing devices using developers for different colors.

For instance, in case electrostatic latent image corresponding to black color picture is formed using optical focusing system, such electrostatic latent image is developed by the black color tonner. The electrostatic latent image corresponding to the picture of particular color formed by the optical output device is developed by the tonner of such color or freely selected desired color.

Thus, the tonner images of double colors are formed on the photosensitive medium and these are transferred at a time on the copying paper.

In this case, the light having passed the lens for magnifying and reducing optical image is separated, and the one enters the picture reading device while the other enters the photosensitive medium through the optical focusing system. Therefore, the electrostatic latent image formed by the optical focusing system well matches the electrostatic latent image formed by the optical output device driven on the basis of the picture signal output from the picture reading device.

The light entering the picture reading device enters, for example, through a filter by the first scanning and also enters without filter by the second scanning.

The particular color element can be extracted by comparing the light entering by the first scanning and the light entering by the second scanning. The filter is provided movable for the light path as explained above.

Figure 24:
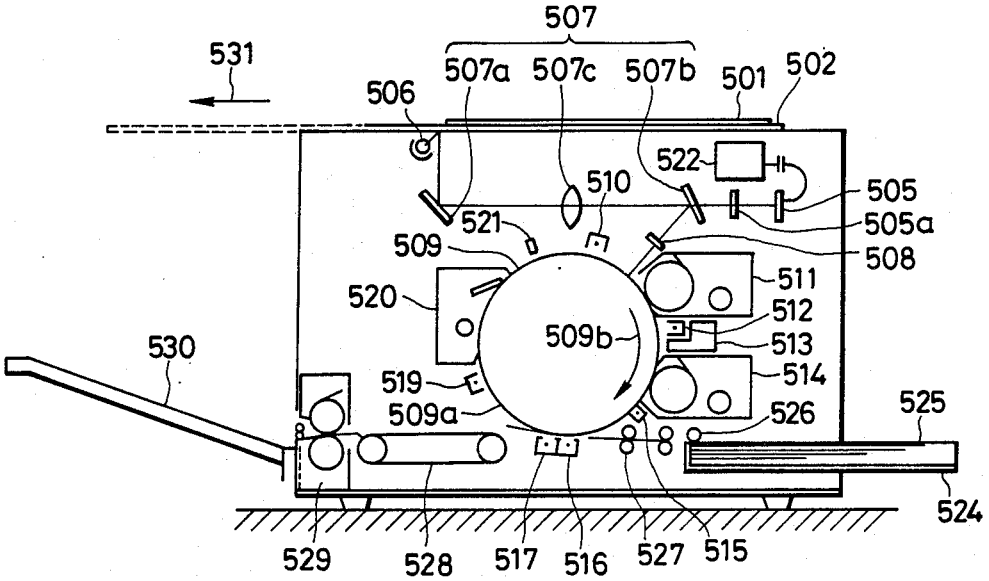
FIG. 24 shows structure of an exampld of a copying apparatus of the sixth embodiment of the present invention.

FIG. 24 shows an example of the copying apparatus of the sixth embodiment.

Overall Structure of Apparatus

This apparatus comprises a platen glass 502 on which an original document 501 is placed, a lamp 506 which irradiates the picture of original document, an optical focusing system 507 consisting of a mirror 507*a* which guides optical image corresponding to the picture on such original document, half mirror 507*b* and lens 507*c*, an optical filter 508 inserted between this optical focusing system 507 and photosensitive medium 509*a*, a picture reading device 505 which receives the light having passed the half mirror 507*b* through a movable filter 505*a* and a signal processing circuit 522 which processes the picture signal obtained by reading said optical image with the picture reading device 505. This movable filter 505*a* is, for example, a filter which transmits red color element and is provided movably for the light image incident path to picture reading device 505 by means of the drive mechanism not illustrated.

The photosensitive drum 509 depositing the photosensitive medium 509*a* at the circumference thereof is supported so that it is rotatably driven in the direction indicated by the arrow mark 509*b* and the circumference is provided with a first charger 510, a first developing device 511, a second charger 512, an optical output device 513, a second developing device 514, pre-transfer corotoron 515, a transfer device 516, a peeling corotoron 517, a preclean corotoron 519, a cleaning device 520 and a discharging lamp 521. The picture signal output from said picture reading device 505 is processed by the signal processing circuit 522 and is connected with the optical output device 513 so that it is driven in accordance with the signal of the particular color element in the picture signal. Connecting path between this signal processing circuit 522 and optical output device 513 is omitted in this specification.

Moreover, this apparatus is provided with a paper feeding tray 524 which accommodates copying paper 525, a paper feed roller 526, a transmitting roller 527, a transmitting belt 528, a fixing device 529 and an exhaust tray 530.

Two Kinds of Electrostatic Latent Images

This apparatus forms two kinds of electrostatic latent images on the photosensitive medium 509*a* with the optical focusing system 507 and optical output device 13. In the present invention, the electrostatic latent image formed by such optical output device 513 is called the first electrostatic latent image and the electrostatic latent image formed by the optical focusing system 507 is called the second electrostatic latent image.

In this example, an optical image guided by the optical focusing system 507 reaches the photosensitive medium 509*a* through an optical filter 508 which transmits the light beam of red color. Thereby, the red color beam reflected by the red color picture in the pictures on the original document reaches the photosensitive medium 509*a* in the intensity near to the white color beam reflected from the white picture part of the background. Therefore, according to the so-called positive writing, the electrostatic latent image corresponding to the red color picture is not formed (discharged like the background) and the electrostatic latent image corresponding to the picture of the other color is formed.

On the other hand, the picture signal read by the picture reading device 505 enters the signal processing circuit 522 and only the signal corresponding to red color picture is extracted from such picture signal. The optical output device 513 is driven by such extracted signal and the electrostatic latent image corresponding to the red color picture is formed on the photosensitive medium 509*a* by so-called negative writing.

Processing of Picture Signal

The picture reading device 505 is the single dimension image pickup element consisting of CCD (Charge Coupled Device) and is used as an ordinary image sensor for reading monochrome picture.

The apparatus of the present invention once scans the picture on the original document to read an optical picture having passed the movable filter 505*a* which transmits the red color with the picture reading device 505. This signal is once stored and in the case of the second trial of scanning, the optical image is directly read by the picture reading device 505. The red color element is extracted through comparison between such read signal and the signal stored previously.

Namely, the signal processing circuit 522 compares the picture signal obtained through the movable filter 5*a* with the picture signal obtained directly without passing the filter for every picture element to judge whether such picture element is red or not. When it is judged as red color, the circuit 522 causes a light emitting element of optical output device 513 to light in order to discharge the photosensitive medium. In this case, since the negative writing is employed, the picture element of red color can be developed with the red color tonner.

As the optical output device 513, various kinds of well known devices such as a light emitting diode array, a liquid crystal microshutter array, a phosphor display tube array, a magnetic optical shutter array and a semiconductor laser scanner may be used.

Formation and developing of electrostatic latent image

The sixth embodiment forms the first electrostatic latent image formed by the optical output device 13 and the second electrostatic latent image formed by the optical focusing system with registration and therefore employs following method for formation and developing of the latent image.

The practical operations are explained with reference to FIG. 24 and FIG. 25.

In FIG. 24, when the platen glass 502 on which the original document 501 is placed is moved in the direction indicated by the arrow mark 531, the first electrostatic latent image and the second electrostatic latent image are formed on the photosensitive medium 509*a* as explained previously (two kinds of electrostatic latent image).

The photosensitive medium 509*a* rotates in the direction indicated by the arrow mark 509*b* in synchronization with transfer of the platen glass 502. The photosensitive medium 509*a* is first subjected to the cleaning of the surface with the preclean corotoron 519 and cleaning device 520 and is then discharged for the unwanted charge with a discharge lamp 521. Next, the photosensitive medium 9*a* is primarily charged (FIG. 25*a*) upto about 1000 V with the first charger 510. Thereafter the second electrostatic latent image is formed by the optical system 507, the red color part and white color part are discharged, for example, to 100 to 150 V and the surface voltage of black color part is kept at about 900 V (FIG. 25*b*). This electrostatic latent image is developed by the developing device 511.

The developing device 511 develops such electrostatic latent image in the first developing process using the black color tonner of negative polarity (FIG. 25*c*). In this case, the developing bias is selected to 200 V.

Next, the second charger 512 charges again the surface of photosensitive medium 509*a* up to 600 V (FIG. 25*d*). For this purpose, the known corotoron is used.

Thereafter, the first electrostatic latent image is formed by the optical output device 513. In this case, the part corresponding to the red color picture is discharged and the surface voltage thereof becomes 100 V (FIG. 25*e*) The developing device 514 then reversely develops such electrostatic latent image using the positive red color tonner (FIG. 25*f*). In this case, the developing bias is selected to 500 V. In this embodiment, the developing device 511 corresponds to the second developing device, while the developing device 514 to the first developing device.

The tonner images of black color and red color are thus formed on the photosensitive medium 509*a* and these tonner images are set to positive by the pre-transfer processing corotoron 515 (FIG. 25*g*).

The copying paper 525 is sent by the paper feed roller 526 from the paper feed tray 524 and is then sent to the transfer device 516 by the transmit roller 527. The tonner images of double color is transferred at a time to the copying paper 525, it is then peeled by the peeling corotoron 517 and is then sent to the fixing device 529 by the transmit belt 528. Finally, the copying paper 525 which has completed the fixing process by the fixing device 529 is exhausted to the exhaust tray 530.

In the case of above processing, the double-color picture is transferred at a time, resulting in an advantage that highly accurate registration of copying paper is no longer required, different from the case where the double-color picture is copied on the copying paper with registration by repeating twice the transfer of picture. Moreover, since the electrostatic latent image of black color picture is formed by the optical focusing system, the high picture quality similar to that of the existing copying apparatus can be guaranteed.

Movable Filter

Figure 26:
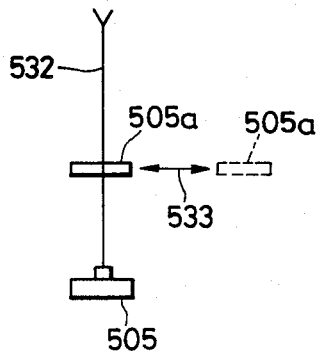
FIGS. 26 and 27 show structures of principal portions of the examples of the movable filters.

For example, as indicated in FIG. 26, the movable filter 505*a* located in front of said picture reading device 505 is provided in such a manner that it moves at the right anglein the direction indicated by the arrow mark 533 for the optical path 532. The filter is set in the light path 532 at the time of first scanning and it is then moved backward at the time of the second scanning.

Figure 27:
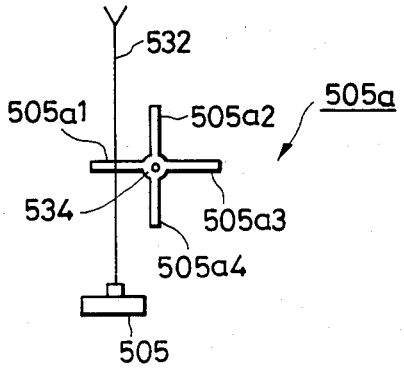

FIG. 27 is a modification example of the movable filter 505*a*. In this example, the red color filter 505*a*1, green color filter 505*a*2, blue color filter 505*a*3 and gray color filter (ND filter) 505*a*4 are respectively provided radially around the rotating axis 534. In this case, extraction of color elements of three colors of red, green and blue can be selected by rotating the filter 505*a*.

Practical Example of Picture Signal Processing

Figure 28:
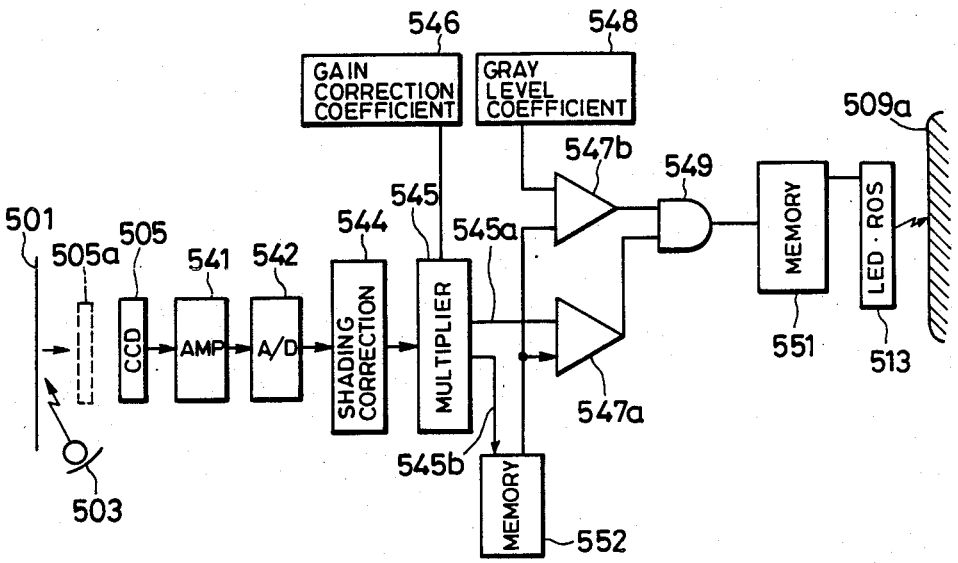
FIG. 28 is a block diagram indicating an embodiment of the signal processing circuit.

FIG. 28 is a block diagram of a picture signal processing circuit.

This circuit irradiates an original document 501 with a lamp 503, receives first the reflected light with the picture reading device 505 through a red color filter 5*a* and then receives it directly with the picture reading device 505, and finally drives the optical output device 513 to form electrostatic latent image corresponding to red color picture on the photosensitive medium 509*a*. The operation thereof is controlled by a microprocessor not illustrated.

The picture signal photoelectrically converted by the picture reading device 505 is amplified in any cases by an amplifier (AMP) 541, then converted into digital signal by an analog/digital (A/D) converter 542 and thereby fluctuation of output can be corrected by the well known shading correction circuit 544.

In addition, a multiplier 545 adjusts level difference of signals generated by sensitivity difference of the picture reading device 505 in case the red color filter 505*a* is inserted or not. The correction coefficient is supplied from a gain correction coefficient circuit 546.

First, when the signal of red color element having passed the red color filter 505*a* is read by the first scanning, such signal is once stored in the memory 552. This memory 552 is a page memory to store the signal for one display screen. The first scanning is intended to store the red color signal 545*b* and the photosensitive drum 509 (FIG. 24) does not rotate.

Next, when the second scanning is started, the photosensitive drum 509 (FIG. 24) starts to rotate and formation of the second electrostatic latent image by the optical focusing system 507 is started.

Simultaneously, the picture reading device 5 starts to read the reflected light which is directly incident from the original document. The picture signal thereof (monochrome signal) 545*a* is processed, like the red color signal 545*b*, by the AMP 541, A/D converter 542, shading correction circuit 544 and multiplier 545 and is then output to the comparator 547*a*.

In the same timing, the red color signal 545*b* being stored in the memory 552 is read and is then output to the comparators 547*a*, 547*b*.

The red color signal 545*b* and monochrome signal 545*a* are compared in the level by the one comparator 547*a*. This comparator provides the high level output when the red color signal 545*b* is higher in the level than the monochrome signal 545*a*.

Meanwhile, the red color signal 545*b* is compared with the reference value output from the gray level coefficient circuit 548 in the another comparator 547*b*. This circuit is provided considering that the red color picture of the concentration higher than the constant level must be copied as the black color picture. Therefore, when the red color signal has the concentration higher than the constant level, the comparator 547*b* provides an output of low level.

The AND circuit 549 sends the high level signal for copying the red color picture to the memory 551 when both outputs of comparators 547*a*, 547*b* become high level. This memory 551 stores the picture signal of one line output from the picture reading device 505 and sends such signal to the optical output device (LED ROS) 513 in the predetermined timing to drive it.

With the processings explained above, the red color signal element is extracted from the picture signal and the first electrostatic latent image is formed corresponding to such red color signal element.

Scanning

As explained earlier, the copying apparatus of the present invention reads an optical image with the picture reading device 505 (FIG. 24) by the first scanning and forms simultaneously the first electrostatic latent image and second electrostatic latent image on the photosensitive medium 509*a* (FIG. 24) by the second scanning.

Here, the scannings are not always required to be conducted in the same direction, and moreover the first scanning may be done as the back-scanning while the second scanning may be done as the fore-scanning.

In this case, the scanning speed is set equal for the fore-scanning and back-schanning.

In some existing copying apparatus, scanning is once conducted to the original document before copying process for automatic exposure adjustment as the prescanning. In such a copying apparatus, the reading operation by the picture reading device is conducted during such pre-scanning. In this case, the present invention can be enforced with the same operations as the operations generally conducted to the apparatus.

In addition, for continuous copying of two or more sheets using the same original document, the single trial of scanning is always required for formation of the second electrostatic latent image by the optical focusing system in order to realize the copying to a sheet of paper, but since the read signal by the picture reading device is already stored in the memory, the second and successive scanning is no longer required.

Scale magnification and reduction

In such copying apparatus, scale magnification or reduction is sometimes requested. In this case, a zoom type lens 507c is used for the optical focusing system 507 in order to directly magnify or reduce the optical image and the corresponding second electrostatic latent image is formed. On the other hand, the picture signal read by the picture reading apparatus 505 is processed for scale magnification or reduction in the signal processing circuit 522 in case such signal is read through the optical system independent of such optical focusing system and this signal drives the optical output device.

In the copying apparatus of the sixth embodiment, the optical image which has passed the lens 507c and is already magnified or reduced is guided to the picture reading device 505 passing the half-mirror 507b. Namely, as is obvious from FIG. 24, the optical image guided to the photosensitive medium 509a is the same as the optical image entering the light receiving surface of the picture reading device 505 passing the half-mirror 507b and therefore there is no fear of generating deviation by registration. In this case, the signal processing circuit 522 is required only to process the readout signal in order to drive the optical output device 513, without complicated magnification or reduction processing for signal. Since density of readout picture of the picture reading device 505 is usually smaller than that of the optical output device 513, the circuit for adjusting such picture density is naturally required.

In case the picture of original document 501 is read using individual light source by the picture reading device 505, the space is as much required. But this device also has an advantage that it can be reduced in size. Here, characteristics of the half-mirror 507b which is provided in the optical focusing system 507 and separates the light into a pair of paths are explained hereunder.

Figure 29:
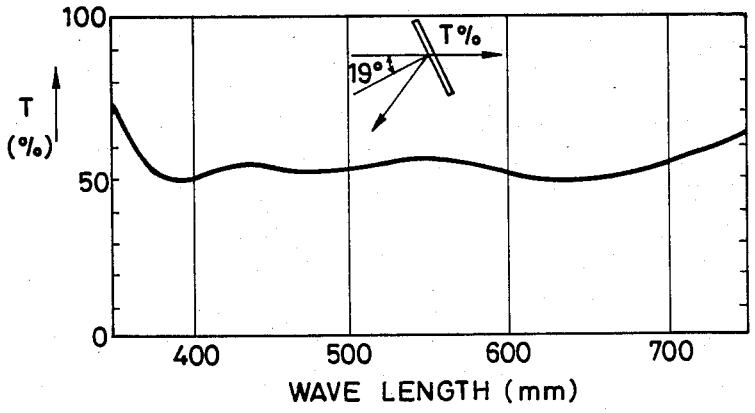
FIG. 29 is a graph indicating characteristics of a half-mirror.

FIG. 29 is an example of the characteristic diagram of a means (half-mirror) to separate the light having passed the lens 507c suitable for enforcement of this example.

This half-mirror has the structure that nonmetallic evaporated film is deposited on the float glass and shows loss of only 5%.

Moreover, the transmission rate T of the incident light with the incident angle of 19° is about 50% and the flat characteristic is obtained for entire part of the visible light. In case there is a difference between the sensitivity of photosensitive medium 509a (FIG. 24) and that of the picture reading device 505 (FIG. 24), it is desirable to make adjustment by adequately changing the reflectivity depending on the structure of the evapolated film of such half-mirror.

The other half-mirror can also be obtained, in addition to said mirror, by vacuum-depositing a metal film such as aluminum (Al) on the float glass, but it shows the large loss of 20% and higher dependency on wavelength.

The dependency on wavelength of the half-mirror is not always required to be flat in the copying apparatus of the sixth embodiment. However, in case the second electrostatic latent image is formed on the photosensitive medium 509a (FIG. 24) by the optical focusing system 507 (FIG. 24), the light should have the particular color element. In addition, since the light entering the picture reading device 505 must also sufficiently include the particular color element for successive extraction of the particular color element. From this fact, it is most desirable for the half-mirror that the dependency on wavelength is flat in the sensitivity region of the picture reading device 505 and that of photosensitivity medium 509a.

Modification Example of Apparatus

Figure 25:
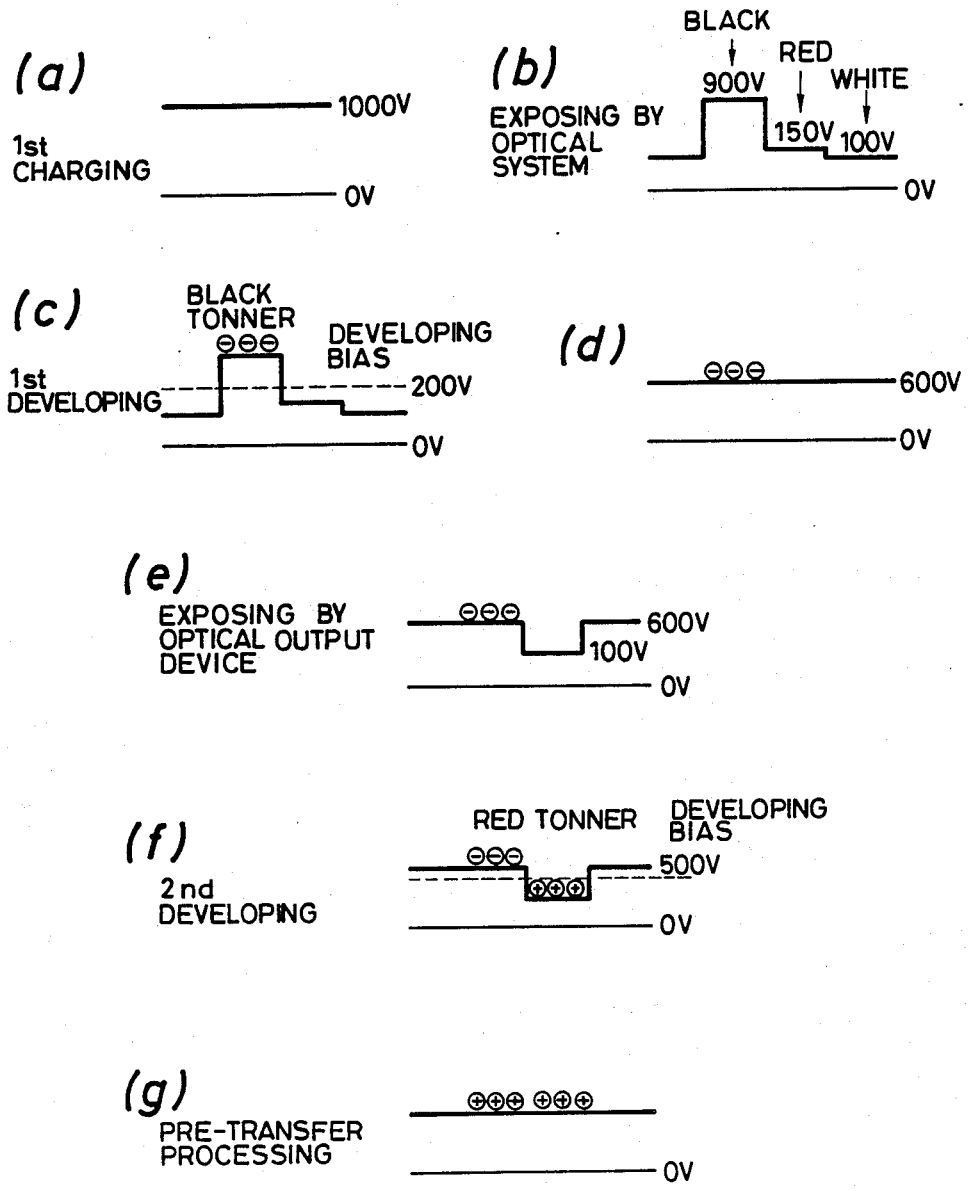
FIG. 25 indicates diagrams for explaining operation of the apparatus of FIG. 24.

In the example of FIG. 24 and FIG. 25, the picture on the original document is separated into the black color element and red color element, and these are respectively developed by the black tonner and red tonner.

However, it is also possible to obtain the copied picture combining desired colors by changing the color of tonner used in each developing device. The black picture may be developed by the blue tonner. Moreover, an optical filter 508 may be changed to the filter of another color.

On the other hand, if the signal of color element extracted from the picture signal can be selected freely in the signal processing circuit 522 and the colors of tonners in the developing devices 511, 514 can be selected freely, not only the original document of double-color of black an red but also the double-color document of black and blue or black and green can also be selected freely.

Figure 30:
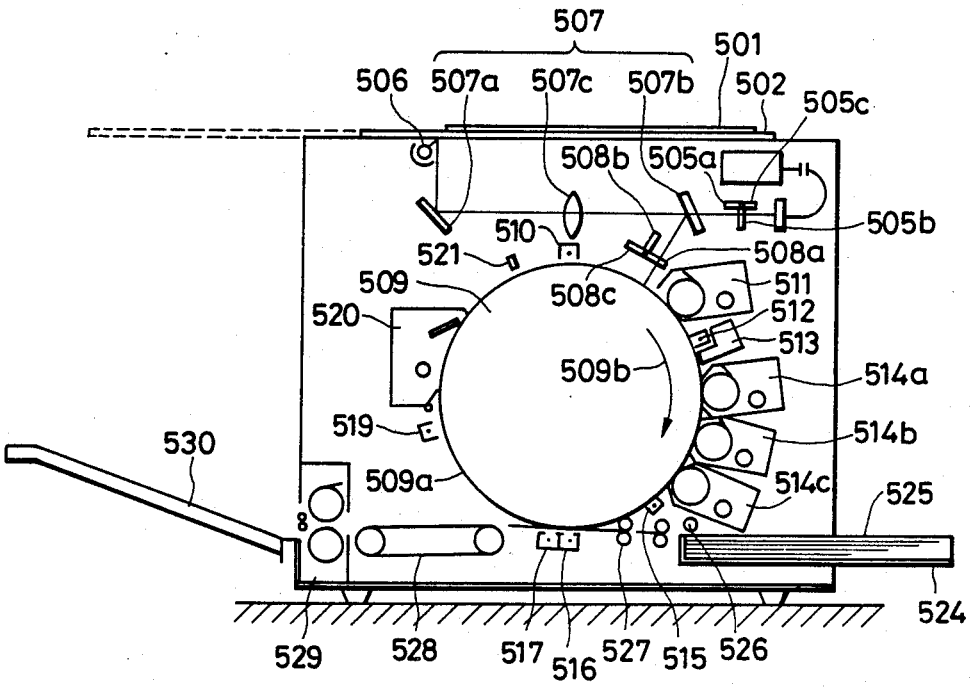
FIG. 30 shows structure of anotehr example of the copying apparatus of the sixth embodiment of the present invention.

FIG. 30 indicates another example of the copying apparatus having such functions.

This copying apparatus is so constituted that the switching for three kinds of modes can be made for extraction of blue color element and green color element in addition to the red color element in the signal processing circuit 522. The circuit structure thereof is the same as that indicated in FIG. 28 and therefore detail explanation is omitted here.

Meanwhile, three types of color filters 508a, 508b, 508c, 505a, 505b, 505c which can be selected by rotation are provided immediately before the optical focusing system 507 and picture reading device 505. 508a, 505a are red color filters, while 508b, 505b are blue color filters and 508c, 505c are green color filters. Moreover, three developing devices 514a, 514b, 514c are provided for developing the first electrostatic latent image formed by the optical output device 513 and the red tonner, blue tonner and green tonner are accommodated in such devices sequentially.

In the apparatus having such structure, for example, the picture on the original document 501 is printed by double colors of black and blue, the signal processing circuit 522 is instructed to extract the blue color signal, a blue color filter 508b is inserted in the optical system 507 and the developing process using the blue color tonner is carried out by operating only the developing device 514b.

The double-color copied picture of black and blue colors can be obtained as explained above.

For successful copying of the picture combining various colors, it is desirable to use a 3-wavelength type fluorescent lamp, day light type fluorescent lamp, white color type fluorescent lamp or xenon lamp covering the spectrometric sensitivity region as the lamp 503 for irradiating the original document.

According to the copying apparatus of the sixth embodiment explained previously, double-color electrostatic latent images are formed on the photosensitive medium by the optical focusing system and picture reading device, these images are individually developed by the tonners of two colors and thereafter these are transferred at a time to a copying paper. Therefore, the transfer processing to the copying paper can be completed by only a single trial of transfer and moreover high precision registration is not required. In addition, the electrostatic latent image is formed using optical focusing system for the principal color element such as black and thereby high quality picture may be copied. Moreover, such high quality copying may also be maintained even in case of the scale magnification and reduction.

Such a two-color copying apparatus in black plus one color of the six embodiment is useful to the original document of which greater part is occupied with black picture.

This is because except for the particular cases, a multi-color original document to be generally used contains characters or figures in black as the greater part of document and also contains, in almost all cases, the underlines or marks in red as the minority of the other colors.

What is claimed is:

1. An image recording method comprising:

a first step of forming a first electrostatic latent image on a latent image carrier and developing the first electrostatic latent image with a first nonmagnetic toner charged to one polarity to form a first toner image;

a second step of forming a second electrostatic latent image on the latent image carrier carrying said first toner image and developing the second electrostatic latent image with double-element developer formed from mixing a second toner charged to a polarity opposite that of the first toner and a magnetic carrier having a density of 4.0 g/cm$^3$ or less to form a second toner image, whereby said first toner image is not disturbed by formation of said second image; and a third step of transferring said first and second toner images to a transfer material.

2. The image recording method of claim 1, wherein the toners used for developing in said first and second steps are toners different from one another for developing two or more colors.

3. The image recording method of claim 1, wherein the toners used for developing in said first and second steps are both for developing the same color.

4. The image recording method of claim 2, wherein said magnetic carrier is formed by dispersing magnetic powder into binder resin, and wherein a developer filling rate of said double-element developer in a developing nip in at least said second step is in a range of 10 to 50%.

5. The image recording method of claim 1, wherein said first electrostatic latent image is a negative latent image and said second electrostatic latent image is a positive latent image.

6. The image recording method of claim 1, wherein said first electrostatic latent image is a positive latent image and said second electrostatic latent image is a negative latent image.

7. The image recording method of claim 1, wherein said magnetic carrier is a low-density carrier formed by dispersing magnetic powder into binder resin.

* * * * *